US006366756B1

(12) United States Patent
Aizawa et al.

(10) Patent No.: US 6,366,756 B1
(45) Date of Patent: Apr. 2, 2002

(54) COLOR IMAGE FORMING APPARATUS

(75) Inventors: Masahiro Aizawa, Osaka; Noboru Katakabe, Kyoto; Masanori Yoshikawa; Kenji Asakura, both of Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/661,389

(22) Filed: Sep. 13, 2000

Related U.S. Application Data

(63) Continuation of application No. 08/960,871, filed on Oct. 31, 1997.

(30) Foreign Application Priority Data

Nov. 5, 1996 (JP) ..... 8-292918

(51) Int. Cl.[7] ..... G03G 15/01; G03G 15/16
(52) U.S. Cl. ..... 399/302; 399/121
(58) Field of Search ..... 399/302, 308, 399/223, 226, 227, 298, 299, 110, 121, 125

(56) References Cited

U.S. PATENT DOCUMENTS

| | | | |
|---|---|---|---|
| 4,662,739 A | 5/1987 | Sakai et al. | 364/142 |
| 4,743,938 A | 5/1988 | Ohno | 399/227 |
| 5,255,063 A | 10/1993 | Ideyama et al. | 399/301 |
| 5,325,151 A | 6/1994 | Kimura et al. | 399/227 |
| 5,442,428 A | 8/1995 | Takahashi et al. | 399/302 |
| 5,515,140 A | 5/1996 | Atsumi et al. | 399/48 |
| 5,528,343 A | 6/1996 | Tada et al. | 399/113 |
| 5,565,975 A | 10/1996 | Kumon et al. | 399/302 |
| 5,585,911 A | 12/1996 | Hattori et al. | 399/227 |

FOREIGN PATENT DOCUMENTS

| | | |
|---|---|---|
| JP | 62-287264 | 12/1987 |
| JP | 63-109462 | 5/1988 |
| JP | 2-12271 | 1/1990 |
| JP | 2-311864 | 12/1990 |
| JP | 4-245856 | 9/1992 |
| JP | 4-324881 | 11/1992 |
| JP | 7-36246 | 2/1995 |
| JP | 7-84430 | 3/1995 |
| JP | 7-104540 | 4/1995 |
| JP | 8-63057 | 3/1996 |
| JP | 8-137171 | 5/1996 |
| JP | 8-314286 | 11/1996 |
| JP | 09-211999 | * 8/1997 |

(List continued on next page.)

*Primary Examiner*—Sophia S. Chen
(74) *Attorney, Agent, or Firm*—Merchant & Gould PC

(57) ABSTRACT

A color image forming apparatus is provided, having a plurality of image forming units including a photosensitive drum, a charging device and a developing device; a carriage for retaining and rotating the plurality of image forming units so as to move the image forming units between an image forming position and a waiting position; an exposing device for exposing a surface of the photosensitive drum of the image forming unit located at the image forming position; an intermediate transfer belt for successive transfer and superposition of toner images of various colors from the photosensitive drum of the image forming units located at the image forming position so as to form a color toner image; a device for driving the photosensitive drum and the intermediate transfer belt; a position detector for detecting a reference position of the intermediate transfer belt when the intermediate transfer belt is driven; and outputting a reference position detection signal; a secondary transfer roller for transferring the color toner image on the intermediate transfer belt onto recording paper; and a controller for controlling the operation of the above structural elements. The controller determines an operation start time of the charging device and the developing device using a rotation command signal to the driving device as a reference, and an operation start time of the exposing device, the intermediate transfer belt and the secondary transfer roller using the reference position detection signal as a reference.

3 Claims, 11 Drawing Sheets

U.S. PATENT DOCUMENTS 5,587,769 A 12/1996 Sawada et al. ..... 399/113
5,587,783 A 12/1996 Nakamura et al. ..... 399/301
5,610,701 A 3/1997 Terada et al. ..... 399/298
5,612,771 A 3/1997 Yamamoto et al. ..... 399/301
5,640,645 A * 6/1997 Namekata et al. ..... 399/302 X
5,652,948 A 7/1997 Sakaguchi et al. ..... 399/66
5,666,596 A 9/1997 Yoo ..... 399/111
5,669,046 A 9/1997 Yoshida et al. ..... 399/167
5,701,568 A * 12/1997 Hiroshima et al. ..... 399/302
5,729,809 A 3/1998 Haneda et al. ..... 399/308
5,787,326 A 7/1998 Ogawa et al. ..... 399/124
5,809,380 A 9/1998 Katakabe et al. ..... 399/227
5,991,589 A * 11/1999 Thompson et al. ..... 399/302 X

* cited by examiner

COLOR IMAGE FORMING APPARATUS

This application is a continuation of application Ser. No. 08/960,871, filed Oct. 31, 1997, which application(s) are incorporated herein by reference.

FIELD OF THE INVENTION

The present invention relates to a color image forming apparatus used in color printers, color copying machines or color facsimiles. More specifically, the present invention relates to a color image forming apparatus that forms a color toner image by overlapping several toner images of various colors on an intermediate transfer device in a primary transfer from several photosensitive drums, and transcribing the color toner image in a secondary transfer to a transfer material (recording paper).

BACKGROUND OF THE INVENTION

FIG. 11 shows the internal structure of a prior art example of a color image forming apparatus, as disclosed in Publication of Unexamined Patent Application (Tokkai) No. Hei 7-36246.

The printer comprises an intermediate transfer belt unit 101 including an-intermediate transfer belt 102, a primary transfer roller 103, a secondary transfer roller 104, a cleaner roller 105, and a waste toner reservoir 106. Composition or superposition of color toner images is performed on the transfer belt 102. A group of image forming units 108 is made up of four image forming units 107Bk, 107Y, 107M and 107C, each unit being of sector shape in cross section. As can be seen in FIG. 11, the image forming units are arranged circularly in the middle of the printer.

When an image forming unit 107Bk, 107Y, 107M or 107C is set properly in the printer, mechanical and electrical connection systems are established between one of the image forming units 107Bk, 107Y, 107M and 107C and the machine body side via mutual coupling members. The image forming units 107Bk, 107Y, 107M and 107C are supported by a supporter, which is rotationally driven by a motor via a cylindrical shaft 109. Each image forming unit 107Bk, 107Y, 107M, and 107C is successively moved by rotation to an image forming position 110. The image forming position 110 is the position where a photosensitive drum 118 of the image forming unit faces the intermediate transfer belt 102 on the primary transfer roller 103, and is also the exposure position for exposure by a laser beam 111.

A laser exposing device 112 is provided in the lower part of the printer. The laser signal beam 111 from the laser exposing device 112 w passes through an opening 113 between the image forming units 107M and 107C, and through an opening provided in the cylindrical shaft 109, and enters a mirror 114. This mirror 114 is positioned inside the shaft 109 and fixed directly to the machine body. The reflected laser beam 111 enters the image forming unit 107Bk located at the image forming position 110 through an opening 115, and passes through the space between a developing device 116 and a cleaner 117 of the image forming unit 107Bk, and enters an exposure portion of the photosensitive drum 118. The laser signal beam 111 is scanned by the exposing device in the direction of the axis of the photosensitive drum 118. The toner image, which is formed on the photosensitive drum 118 by exposure with the laser signal beam 111 and subsequent development with the developing device 116, is transferred to the intermediate transfer belt 102.

Then, the group of image forming units 108 rotates by 90 degrees, so that the yellow image forming unit 107Y moves to the image forming position 110 to replace the black image forming unit 107Bk. An operation similar to the operation explained above for the black image is performed to form a yellow image overlaying the black image formed on the intermediate transfer belt 102. Subsequently, the magenta and cyan image forming units 107M, 107C are moved to the image forming position 110, and similar operations as explained above are repeated to compose a full color image on the intermediate transfer belt 102. This full color image is further transferred from the intermediate transfer belt 102 onto a recording paper using a secondary transfer roller 119, and the image on the paper is fixed by a fixing device 120.

In the color image forming apparatus as explained above, precise registration of the toner images of all four colors is very important for obtaining a high quality full color image. However, an image forming unit system of the prior art as explained above, which forms a color image by overlaying successively four toner images of four photosensitive drums at one image forming position onto an intermediate transfer device (belt) and forms a color image on the recording paper by a secondary transfer from the intermediate transfer device, has the following disadvantage: After the start-up (power on), variations of the time until a rotation of the intermediate transfer device is in a stable condition (start-up time) and loss of the driving system can occur easily. Therefore, the rotational position of the intermediate transfer device at a predetermined time after the start-up is not necessarily a predetermined position. Consequently, it is necessary to ensure that sufficient time has passed so that the rotation of the intermediate transfer device is in a stable condition in order for a high quality image to be provided.

On the other hand, there is the strong desire to accelerate the recording operation. The time spent until the four image forming units comprising a photosensitive drum have been switched, and the rotation of the intermediate transfer device has been stabilized, is reflected in the time that the color image forming device needs for forming an image.

Moreover, the circumference of the intermediate transfer belt has an influence on the size of the entire device. Therefore, to make the circumference of the intermediate transfer belt as small as possible is desirable in order to miniaturize the device.

A main object of the present invention is to solve the problems mentioned above by providing a color image forming apparatus combining improvement of the image quality and the image forming speed with miniaturization of the entire device.

SUMMARY OF THE INVENTION

A color image forming apparatus according to the present invention comprises: a plurality of image forming units corresponding to various colors, the image forming units including a photosensitive drum, a charging device and a developing device; a unit retaining member for retaining the image forming units and moving the image forming units between an image forming position and a waiting position; an exposing device for exposing the photosensitive drum of the image forming units when located at the image forming position; an intermediate transfer belt for successive transfer and superposition of toner images of various colors from the photosensitive drum of the image forming units located at the image forming position so as to form a color toner image; means for driving the photosensitive drum and the intermediate transfer belt; a detector for detecting a reference position of the intermediate transfer belt when the intermediate transfer belt is driven, and outputting a reference position detection signal; a secondary transfer device for transferring the color toner image on the intermediate transfer belt onto paper; and a controller for controlling the operation of the above structural elements. The controller determines an operation start time of the charging device and the developing device using a rotation command signal to the driving means as a reference, and an operation start time of the exposing device, the intermediate transfer belt and the secondary transfer device using the reference position detection signal as a reference.

Usually, the start and the stop of the photosensitive drum and the intermediate transfer belt is performed for each color. In that case however, variations of the time until a rotation of the intermediate transfer device is in a stable condition (start-up time) and loss of the driving system can occur easily. In the configuration according to the present invention however, the detector detects a reference position of the intermediate transfer belt after the driving of the intermediate transfer belt is started and outputs this reference position detection signal. The positioning of the overlayed toner image, which is transferred onto the intermediate transfer belt, becomes easier and more precise, because the operation start time for the exposing device, the intermediate transfer belt and the secondary transfer device are determined using the reference position detection signal. Positioning for the secondary transfer from the intermediate transfer belt onto paper becomes more precise as well.

On the other hand, the charging of the photosensitive drum before the photosensitive drum reaches a constant rotational velocity can be performed without problems. It is preferable that the charging of the photosensitive drum starts as early as possible after the start of the photosensitive drum, so that a larger charging portion on the surface of the photosensitive drum can be ensured. Especially in the case of the contact development method, wherein the developing roller is always contacting the photosensitive drum, it is preferable that a developing bias is impressed as early as possible after the start of the photosensitive drum for development. If this is not done, an unwanted use of toner can occur, because toner covers an unexposed area of the photosensitive drum as well. According to the configuration of the present invention, the charging and the developing of the photosensitive drum can be started as early as possible after the start of the photosensitive drum, because the operation start time of the charging device and the developing device are determined using a rotation command signal to the driving means as a reference.

It is preferable that a selection between a first control mode and a second control mode is possible, the first control mode being characterized in that the exposure by the exposing device begins after the photosensitive drum charged by the charging device has been rotated for at least one rotation, and the second control mode being characterized in that the exposure by the exposing device begins before the photosensitive drum charged by the charging device has been rotated for one rotation. The first control mode is a high image quality mode, wherein the exposure is started when the electric potential of the photosensitive drum is in a sufficiently stable condition, and the second control mode is a high speed mode, wherein a high recording speed is preferred. It is furthermore preferable that, when the first control mode is selected, the controller starts the rotation of the intermediate transfer belt after the photosensitive drum has been rotated for at least one rotation. By doing so, the length of the intermediate transfer belt can be shortened, and thus the miniaturization of the entire device can be enhanced.

It is preferable that (i) the secondary transfer device comprises a secondary transfer roller that can be switched between a state in contact to the intermediate transfer belt and a state in separation from the intermediate transfer belt, (ii) the color toner image is transferred from the intermediate transfer belt onto paper while the paper passes by when the intermediate transfer belt and the secondary transfer roller are in contact, and (iii) in the case that the first control mode has been selected, the controller maintains a separation between the secondary transfer roller and the intermediate transfer belt while the photosensitive drum is being exposed by the exposing device and while the toner image is being transferred from the photosensitive drum to the intermediate transfer belt. By doing so, the running of the intermediate transfer belt can be stabilized and an image with a high image quality can be formed.

It is preferable that the color image forming apparatus further comprises a paper feed device for feeding paper synchronized by the reference position detection signal. The paper feed device is controlled by the controller so that, in the case that the first control mode has been selected, the paper feed device does not feed paper while the photosensitive drum is being exposed by the exposing device and while the toner image is being transferred from the photosensitive drum to the intermediate transfer belt. By doing so, disturbances due to the paper feed operation can be prevented and an image with a high image quality can be formed.

It is preferable that the color image forming apparatus further comprises a cleaning means, which can be switched between a state in contact to the intermediate transfer belt and a state in separation from the intermediate transfer belt, and cleans remaining toner from the surface of the intermediate transfer belt in the contact state. In the case that the first control mode has been selected, the controller maintains a separation between the cleaning means and the intermediate transfer belt while the photosensitive drum is being exposed by the exposing device, while the toner image is being transferred from the photosensitive drum to the intermediate transfer belt and while the toner image is being transferred by the secondary transfer device from the intermediate transfer belt onto paper. By doing so, the running of the intermediate transfer belt can be stabilized and an image with a high image quality can be formed.

It is preferable that the controller stops the driving means while the plurality of image forming units retained by the unit retaining member is moved, and the image forming unit corresponding to a color of the plurality of image forming units that is not being used for image formation is skipped and only the image forming units corresponding to colors that are used for image formation are moved successively to the image forming position. By doing so, the different colors of the color toner image can be overlayed on the surface of the intermediate transfer belt without position variation while the color image formation can be accelerated.

It is preferable that the driving means has a single driving source driving the photosensitive drum and the intermediate transfer belt, which driving source, after being stopped by the controller, can be driven in reverse to run back the intermediate transfer belt for a predetermined length when the image forming units are switched. With such a driving method, a miniaturization of the entire device can be enhanced, because the length of the intermediate transfer belt can be shortened. It is even more preferable that the color image forming apparatus further comprises a driving force interrupting means for interrupting the transmission of a driving force from the driving means to the photosensitive drum, wherein the controller interrupts the transmission of a driving force with the driving force interrupting means when the driving source is driven in reverse to run back the intermediate transfer belt for a predetermined length.

It is preferable that the controller can drive the driving source in reverse to run back the intermediate transfer belt for a predetermined length while the image forming units are moving. It is even more preferable that the running direction of the intermediate transfer belt in a portion facing the photosensitive drum is the same direction as the moving direction of the image forming unit when the driving source has been driven back. In this case, the length of the intermediate transfer belt can be shortened and the life expectancy of the intermediate transfer belt can be prolonged, because friction between the photosensitive drum and the intermediate transfer belt can be kept low when the image forming unit is moved.

DESCRIPTION OF THE PREFERRED EMBODIMENTS

In the following, a color image forming apparatus according to a first embodiment of the present invention is explained with reference to the drawings.

First Embodiment

Figure 1:
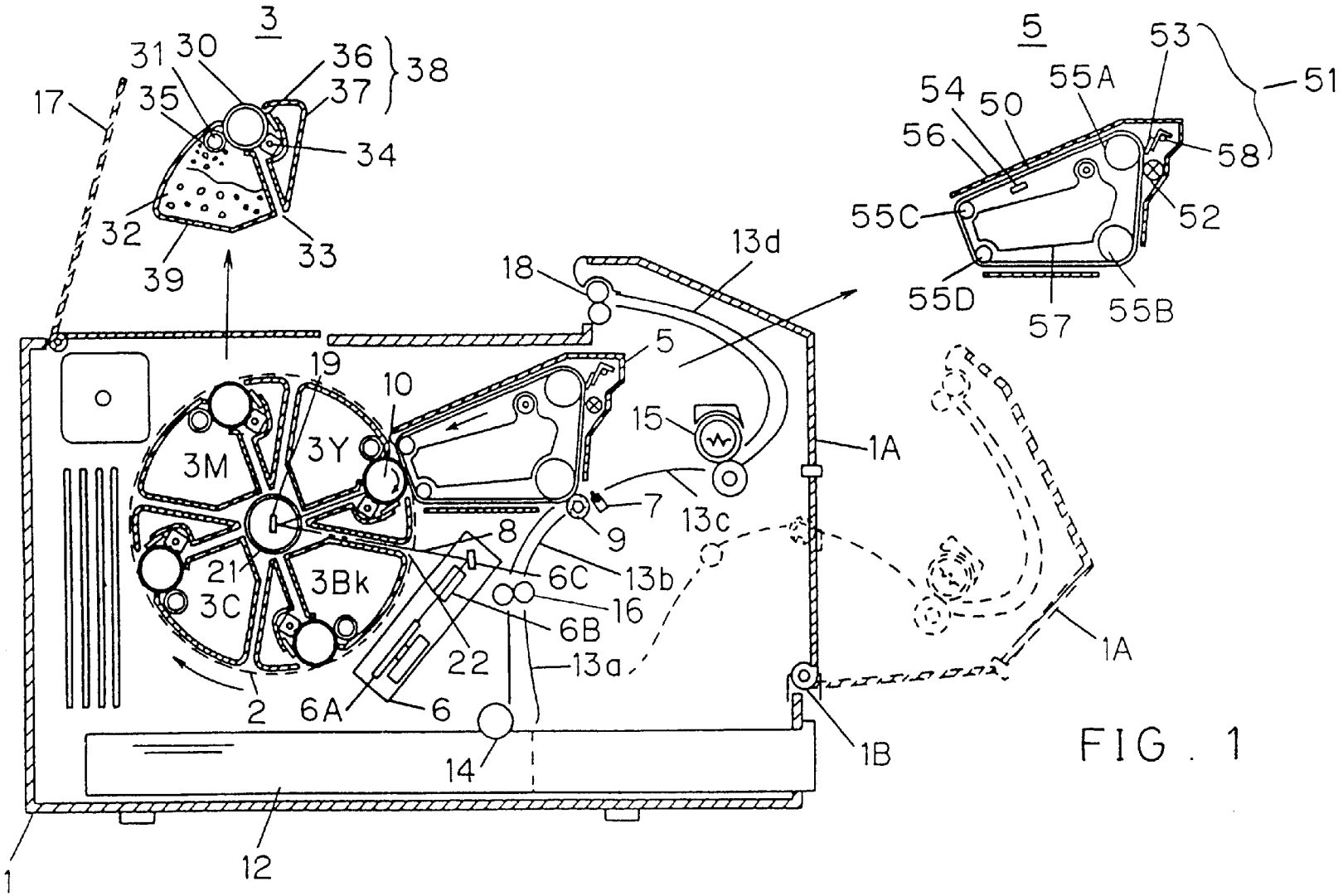
FIG. 1 is a cross section of a first embodiment of the color image forming apparatus according to the present invention, showing the inner structure in a side view.

FIG. 1 illustrates the structure and operation of a color image forming apparatus according to the first embodiment of the present invention. FIG. 1 is a side view of the internal structure of the color image forming apparatus.

First, the image forming units are explained. In FIG. 1, image forming units 3 are provided for the four colors yellow, magenta, cyan and black. The image forming units are integrated devices comprising a photosensitive drum 30 and peripheral process elements. Each image forming unit includes a corona charger 34 that charges the photosensitive drum 30 evenly with a negative voltage, a developing device 35 having a developing roller 31, and a toner hopper 39.

The toner hopper 39 contains a toner 32 that can be negatively charged and is made of polyester resin and pigment dispersed in the resin. The toner 32 is carried by the surface of the developing roller of the developing device 35 to develop the photosensitive drum 30. There is a cleaner 38 provided for cleaning remaining toner on the surface of the photosensitive drum 30 after image transfer is completed. The cleaner 38 comprises a cleaning blade 36 made of rubber and a waste toner reservoir 37 that collects waste toner. There is an opening 33 for a laser beam signal 8 to enter the image forming unit 3. The photosensitive drum 30 has an outer diameter of 30 millimeters. The developing roller of the developing device 35 has an outer diameter of about 16 millimeters. The photosensitive drum 30 and the developing roller are rotatably mounted on side walls of the image forming unit 3.

Next, the transfer belt unit is explained. A transfer belt unit 5 is provided for receiving a toner image formed on the photosensitive drum 30 at an image forming position 10 and reforming the toner image on a recording paper sheet. The transfer belt unit 5 is attached to the machine body 1 removably and comprises integrated members such as an intermediate transfer belt 50, a group of guide pulleys 55A–55D for supporting the belt 50, a cleaner 51, and a waste toner container 57 for collecting waste toner after cleaning.

The intermediate transfer belt 50 is an endless belt with a total thickness of 100–300 micron, comprising a urethane base that has a semiconducting property and thickness of approximately 100 micron, and a surface layer made of a fluororesin such as polytetrafluoroethylene (PTFE) or a copolymer of tetrafluoroethylene and perfluoroalkylvinylether (PFA). For example, a perimeter of the intermediate transfer belt is 377 millimeters, which corresponds to a length of A4 paper size (297 millimeters) plus half the perimeter of the photosensitive drum (diameter is 30 millimeters) plus some addition so that A4 size and letter size paper sheets can be used for printing.

The cleaner 51 is provided for cleaning or wiping the toner that remained on the intermediate transfer belt 50. The cleaner 51 comprises a cleaning blade 53 made of rubber and a screw 52 for carrying the wiped toner into the waste toner container 57. This cleaner 51 moves away from the intermediate transfer belt 50 by pivoting on a bearing 58 during the formation of a color image on the intermediate transfer belt 50, so that it does not erase the toner image formed on the intermediate transfer belt 50.

The guide pulley 55A serves as a driving pulley for the intermediate transfer belt as well as a backup roller of the cleaning blade 53. The guide pulley 55B serves as a backup roller for the secondary transfer roller 9 for transferring a toner image from the intermediate transfer belt onto a paper sheet. The guide pulley 55C applies a primary transfer bias for transferring a toner image from the photosensitive drum 30 to the intermediate transfer belt 50. The guide pulley 55D serves as a tension pulley for applying a tension to the intermediate transfer belt 50. The intermediate transfer belt 50 is put over these guide pulleys and rotates in accordance with rotation of the driving pulley 55A. The intermediate transfer belt 50 is protected by a cover 56.

Next, the carriage is explained. As shown in FIG. 1, wherein the front side of the apparatus is at the right side of FIG. 1, there is a carriage 2 in the center portion of the machine body 1. In the front side of the machine body 1, there is a front alligator opening 1A, and there is a top door 17 on the top of the machine body. The carriage 2 carries four color image forming units 3Y, 3M, 3C, and 3Bk. The carriage 2 is rotatably mounted on the machine body 1 so as to rotate around the axis of a cylindrical shaft 21. Thus, each photosensitive drum 30 can move between the image forming position 10 and waiting positions.

By opening the top door 17, the image forming unit 3 can be taken by its handle (not shown in the figure) and easily removed from the carriage 2 or inserted in the carriage 2. Therefore, if one of the image forming units 3 needs to be replaced, it can be replaced by rotating the carriage 2 so that the image forming unit 3 is located under the top door 17, and opening the door 17. Each color image forming unit 3 operates only when it is located at the image forming position 10, where the photosensitive drum 30 of the image forming unit 3 at the image forming position 10 is scanned by the laser beam 8 and in contact with the transfer belt unit 5. Therefore, in the image forming position 10, the image forming unit 3 is connected mechanically to the drive mechanism and electrically to a power source or other device of the machine body 1. In the waiting positions, the image forming unit 3 does not operate.

Next, the front alligator opening is explained. The front alligator 1A is pivoted on the machine body 1 by a hinge 1B so as to open to the front. A fixing device 15, a secondary transfer roller 9, a discharging needle 7, and front side portions of paper guides 13*a*–13*d* are attached on the inner surface of the front alligator 1A. These members accompany the front alligator 1A when it opens, so that a large opening appears in the front side of the machine body when the front alligator 1A is opened. Thus, setting or removing of the transfer belt unit 5 become easier, and removing of jammed paper becomes easier, too.

The transfer belt unit 5, when placed properly in the machine body 1, is positioned precisely and a portion of the intermediate transfer belt facing the photosensitive drum 30 is located at the image forming position 10. Each portion of the transfer belt unit is connected to the machine body electrically and the driving pulley 55A is connected to the driving mechanism of the machine body 1 so that the intermediate transfer belt 50 can rotate. The discharging needle 7 is provided to prevent a toner image on the paper from deteriorating when the paper is separated from the intermediate transfer belt 50.

Moreover, the cleaning blade 53 is pressing on the intermediate transfer belt 50 when the image formation in the machine body 1 is stopped. This is to prevent spilling of the toner from the cleaner 51 when the transfer belt unit 5 is removed from the machine body or inserted in the machine body.

Next, the exposing device is explained. A laser exposing device 6 is provided under the transfer belt unit 5. The laser exposing device 6 comprises a semiconductor laser (not shown in the drawing), a polygon mirror 6A, a lens system 6B, a first mirror 6C and other members. As shown in FIG. 1, a laser signal beam 8, which corresponds to a sequential pixel signal of an image information, passes through an opening 22 between the waste toner reservoir 37 of the image forming unit 3Y and the toner hopper 39 of the image forming unit 3Bk, and passes through an opening (not shown in the drawing) provided in the cylindrical shaft 21, and enters the mirror 19 that is located in the cylindrical shaft 21 and directly fixed to the machine body 1. The laser beam 8, after reflecting on the mirror 19, enters the image forming unit 3Y through an opening 33 of the image forming unit 3Y that is located at the image forming position. Then, the laser beam enters a photosensitive portion of the photosensitive drum 30. The laser beam is scanned in the direction of the axis of the photosensitive drum 30 to expose the photosensitive drum 30.

Next, the paper feed system is explained. The paper feed system comprises a paper feed unit 12, a paper feed roller 14, a resist roller 16, a paper ejection roller 18, and paper guides 13*a*, 13*b*, 13*c*, 13*d* provided among these rollers, a contact portion of the intermediate transfer belt 50 and the secondary transfer roller 9, and the fixing device 15.

Next, a full color image forming process in the operation of the machine is explained. When electric power is supplied to the machine body 1, the initializing mode is started. The presence of the transfer belt unit 5 and all image forming units 3 is confirmed and an error check of all process members is performed.

To be specific, the presence of the transfer belt unit 5 is confirmed with a transfer belt unit presence sensor (not shown in the drawing), and in the case that the transfer belt unit 5 has not yet been inserted, a message asking for insertion of the transfer belt unit is displayed on a display (not shown in the drawing), until the transfer belt unit 5 has been inserted. Next, the carriage 2 carrying the image forming units 3 is rotated once, and an image forming unit presence sensor (not shown in the drawing) detects whether all image forming units 3 have been inserted.

If not all image forming units 3 are inserted, the carriage 2 is moved to an exchange position (a position at the opening of the top door 17), and a message asking for insertion of the missing image forming unit 3 is displayed on a display (not shown in the drawing), until the missing image forming unit 3 has been inserted. If there is still an image forming unit missing after the designated image forming unit 3 has been inserted, the same procedure is repeated. After it has been confirmed, that all image forming units 3 have been inserted, the yellow image forming unit 3Y is moved to the image forming position 10 and retained there.

Then, a process confirmation mode for all process member starts. First of all, the fixing device 15 is heated up, and the polygon mirror 6A of the laser exposing device 6 begins to rotate. After the polygon mirror 6A reaches a certain rotational speed, confirmation of the process members is performed using the yellow image forming unit 3Y The photosensitive drum 30, the intermediate transfer belt 50 and the developing roller 31 are rotated, and an electrification voltage is impressed on the corona charger 34. A developing bias is impressed on the developing roller 31 and a transfer bias voltage is impressed on the intermediate transfer belt 50. After the intermediate transfer belt 50 as been rotated for about one rotation, all operations are stopped, and the magenta image forming unit 3M is moved to the image forming position 10. Next, using the magenta image forming unit 3M, the confirmation of process parts is performed similar to that with the yellow image forming unit 3Y. Then, after the confirmation of the process parts has also been performed for the cyan and black image forming units 3C and 3Bk in a similar manner, the initialization operation is finished, and the preparation for image formation is complete.

When the preparation is finished, the image formation of the yellow image forming unit 3Y in the image forming position 10 is started. When the photosensitive drum 30, which is connected to a driving source in the machine body 1, starts to rotate in the image forming position 10, the developing device 35, the charger 34 and the intermediate transfer belt 50 start to move simultaneously. When the driving pulley 55A is driven by the machine body, the intermediate transfer belt 50 is driven in the direction of the arrow due to friction forces. The peripheral velocity of the photosensitive drum 30 and the peripheral velocity of the intermediate transfer belt 50 are set to substantially the same velocity. Moreover, the secondary transfer roller 9 and the cleaner 51 are away from the intermediate transfer belt 50.

0.1 sec after the driving source has started the rotation, the charger 34 impresses an electrification voltage, and a charging operation begins. Then, the surface of the photosensitive drum 30 is charged by the charger 34, and when an evenly charged portion comes into an exposure position, a position sensor detects a home position of the intermediate transfer belt 50. The laser signal beam 8, which is output from the laser exposing device 6 according to an image signal, is synchronized with this detection signal. The evenly charged photosensitive drum 30 is irradiated by the laser signal beam 8, and a static latent image is formed according to the image signal.

This static latent image is subsequently made manifest by the developing device 35, and a toner image is formed. Then, the toner image formed on the photosensitive drum 30 is moved to a primary transfer position contacting the intermediate transfer belt 50, and is subsequently copied onto the intermediate transfer belt 50. The above operation is continued for a A4-sized image, and after the end of the image has been transferred to the intermediate transfer belt 50, the yellow image formation process is finished. After this, the photosensitive drum 30 and the intermediate transfer belt 50 are moved to an initialization position.

Then, the charger 34 charges the photosensitive drum 30 at −450 volts. The exposing voltage of the photosensitive drum is −50 volts. DC potential of +100 volts is applied to the developing roller 31 when a portion of the photosensitive drum 30, which is not charged yet, passes the developing roller. Then, 0.3 sec after the driving source has begun the rotation, the evenly charged surface of the photosensitive drum 30 passes the developing roller, and DC potential of −250 volts is applied to the developing roller 31. Synchronized with the detection signal output from a position sensor 54 of the intermediate transfer belt 50, a DC voltage of +1.0 kilovolts is applied to the guide pulley 55C and the tension pulley 55D of the intermediate transfer belt 50.

The driving mechanism of the machine body 1 releases the coupling with the photosensitive drum 30 when the photosensitive drum 30 and the intermediate transfer belt 50 stop after the yellow image formation is completed. Then the carriage 2 rotates 90 degrees in the direction of the arrow, so that the yellow image forming unit 3Y moves away from the image forming position 10 and the magenta image forming unit 3M moves into the image forming position 10. When the magenta image forming unit 3M stops at the image forming position 10, the driving mechanism of the machine body 1 engages the magenta photosensitive drum 30. Then the magenta image forming unit 3M and the transfer belt unit 5 start to operate for magenta image formation. A similar operation is performed as for yellow image formation, so that the magenta toner image is formed overlaying the yellow toner image on the intermediate transfer belt 50. The above operation is repeated in order for cyan and black, so that a four-colored toner image is formed on the intermediate transfer belt 50.

After the black toner is being formed, 1.4 sec after the generation of the detection signal from the position sensor 54, the top of the image comes to the position of the secondary transfer roller 9. Therefore, the secondary transfer roller 9 approaches the intermediate transfer belt 50 at 0.2 sec before the top of the toner image reaches the secondary transfer roller 9. Simultaneously, a paper sheet is fed from the paper feed unit 12 and further fed while being held between the secondary transfer roller 9 and the intermediate transfer belt 50, while the timing is checked with the resist roller 16. Thus, the four-colored toner image as a whole is transferred onto the paper sheet. At this time, a DC voltage of +300 volts is applied to the secondary transfer roller 9. The paper on which the toner image is transferred passes through the fixing device 15, which fixes the toner image. Then, the paper sheet is ejected by the ejecting roller 18.

The remaining toner on the intermediate transfer belt 50 is wiped off after the second transfer by the cleaning blade 53, which contacts with the intermediate transfer belt 50. The wiped toner is collected into the waste toner container 57 with the screw 52. Because the cleaning blade 53 is away from the intermediate transfer belt 50 while the color image is formed, the cleaning blade 53 is put into contact with the intermediate transfer belt 50 to clean the surface of the intermediate transfer belt 50. This contacting time is determined based on the detection signal output by the position sensor 54.

After finishing the second transferring and the cleaning to the intermediate transfer belt, the intermediate transfer belt 50 and the image forming unit 3 stop again. Then the carriage 2 rotates 90 degrees so that the yellow image forming unit 3Y moves to the image forming position 10 again. Thus, the color image formation is completed. The second transferring and the cleaning of the intermediate transfer belt 50 can be performed simultaneously with the (final) recording of black, or after the recording of black by rotating the intermediate transfer belt 50 again.

Next, an image formation without using all four colors of toner is explained. Such an image formation also includes the cases of image formation without using the black toner, that is using only the yellow toner, the magenta toner and the cyan toner, monocolored image formation with only a single toner and multicolor image formation using an arbitrary plurality of toners. As an example, a multicolored image formation using yellow toner and cyan toner is explained below.

When the preparation for image forming is finished, first, the yellow image forming unit 3Y is moved to the image forming position 10, and image forming is performed, similar to the full color image forming process.

After the yellow image forming has been finished, the photosensitive drum 30 and the intermediate transfer belt 50 are stopped, and the driving mechanism of the machine body 1, which has been connected to the yellow photosensitive drum 30, is disconnected from the photosensitive drum 30. The carriage 2 moves 180 degrees in the arrow direction, and the yellow image forming unit 3Y is moved away from the image forming position 10. This time, the magenta image forming unit 3M is left out, and the cyan image forming unit 3C is moved into the image forming position 10.

When the cyan image forming unit 3C is moved into the image forming position 10, the driving mechanism of the machine body 1 is connected to the cyan photosensitive drum 30, the image forming unit 3C and the transfer belt unit 5 start operation, and image forming is performed similar to that of the case of yellow. As a result, a yellow toner image and a cyan toner image are formed overlapping on the intermediate transfer belt 50, thereby forming a green toner image.

After this, when the secondary transfer process has been finished, the recording paper onto which the green toner image has been transferred passes the fixing device 15, the image is fixed, and is ejected by the paper ejection roller 18. The toner that remained on the intermediate transfer belt 50 after the secondary transfer is cleaned similarly as in the full color image formation process. The intermediate transfer belt 50 and the image forming unit 3 are stopped again, and the carriage 2 turns 90 degrees. Therefore, the yellow image forming unit 3Y moves again into the image forming position 10, and the forming operation of the multicolored image is finished.

Next, an image formation using only the black toner is explained. First of all, the driving mechanism of the machine body, which has been connected to the yellow photosensitive drum 30, is disconnected from the photosensitive drum 30. The carriage 2 is rotated 270 degrees in the arrow direction. Consequently, the yellow image forming unit 3Y is moved away from the image forming position 10, and the black image forming unit 3Bk is moved into the image forming position 10. When the black image forming unit 3Bk stops, the driving mechanism of the machine body 1 is connected to the black photosensitive drum 30, and the image formation process using the image forming unit 3Bk begins.

Next, the black photosensitive drum 30, which is connected to the driving mechanism of the machine body 1, starts to revolve in the image forming position 10. Simultaneously, the developing device 35 and the intermediate transfer belt 50 start to move, and the paper feed unit 12 starts to feed recording paper. In addition, the secondary transfer roller 9 is pressed against the intermediate transfer belt 50, and the cleaning blade 53 stays pressed against the intermediate transfer belt 50.

0.1 sec after the driving source has started the rotation, the charger 34 impresses an electrification voltage, and a charging operation begins. The surface of the photosensitive drum 30 is charged by the charger 34, and when an evenly charged portion comes into an exposure position, a position sensor detects the home position of the intermediate transfer belt 50. The laser signal beam 8, which is output from the laser exposing device 6 according to an image signal, is synchronized with this detection signal.

When the evenly charged photosensitive drum 30 is irradiated by the laser signal beam 8, a static latent image is formed according to the image signal. This static latent image is subsequently made manifest by the developing device 35, and a toner image is formed. Then, the toner image formed on the photosensitive drum 30 is moved to a primary transfer position contacting the intermediate transfer belt 50, and is subsequently copied onto the intermediate transfer belt 50. After the toner image has been copied, the remaining toner is taken from the surface photosensitive drum 30 by the cleaning blade 36 for preparation of the next image formation process, that is recharging, exposure and developing.

After the black toner is being formed, 1.4 sec after the generation of the detection signal from the position sensor 54, the top of the image comes to the position of the secondary transfer roller 9. Therefore, a paper sheet is fed from the paper feed unit 12 and further fed being held between the secondary transfer roller 9 and the intermediate transfer belt 50, while the timing is checked with the resist roller 16. Thus, the black toner image is transferred onto the paper sheet. The paper sheet on which the toner image is transferred passes through the fixing device 15 that fixes the toner image. Then, the paper sheet is ejected by the ejecting roller 18.

Any toner remaining on the intermediate transfer belt 50 is wiped off after the second transfer by the cleaning blade 53, which contacts the intermediate transfer belt 50. After the secondary transfer and the cleaning is finished, the intermediate transfer belt 50 is ready to perform the next transfer process. Until successive image formation is finished, the same operations as explained above are repeated. Then, the carriage 2 rotates by 90 degrees, so that the yellow image forming unit 3Y reaches the image forming position 10 again, and thus the image formation operation of forming a single-colored image is finished.

When a single-colored image formation as described above is performed successively, the successive image formation operation is interrupted regularly, and a toner supplying operation is performed by rotating the carriage 2 at least once, in order to avoid a shortage of toner supply. When a single-colored image formation is continued for a long time with the image forming unit 3 fixed in the image forming position, toner 32 is accumulated at the bottom of the toner hopper 39, because the relative position of the toner hopper 39 of the developing device 35 and the developing roller 31 are fixed, and no toner 32 is supplied to the developing roller 31. It is preferable that the frequency of the toner supplying operation is adapted to the consumed amount of the toner. For example, it is possible to use a method wherein the time that the laser signal beam 8 is excited by the laser exposing device 6 is measured, or a method wherein the changes in the weight of the developing device 35 are detected, or a method wherein the number of printed papers is counted.

Usually, an imageless area can be set on a surface of the intermediate transfer belt 50 for a single-colored image formation process, same as for a multi-colored image formation process, because for a single-colored image formation process, same as for a multi-colored image formation process, the exposing operation onto the photosensitive drum 30 is synchronized with the home position of the intermediate transfer belt 50. Consequently, even when the imageless area of the intermediate transfer belt 50 suffers some damage by abrasion through the photosensitive drum 30, the image quality does not deteriorate.

Figure 2:
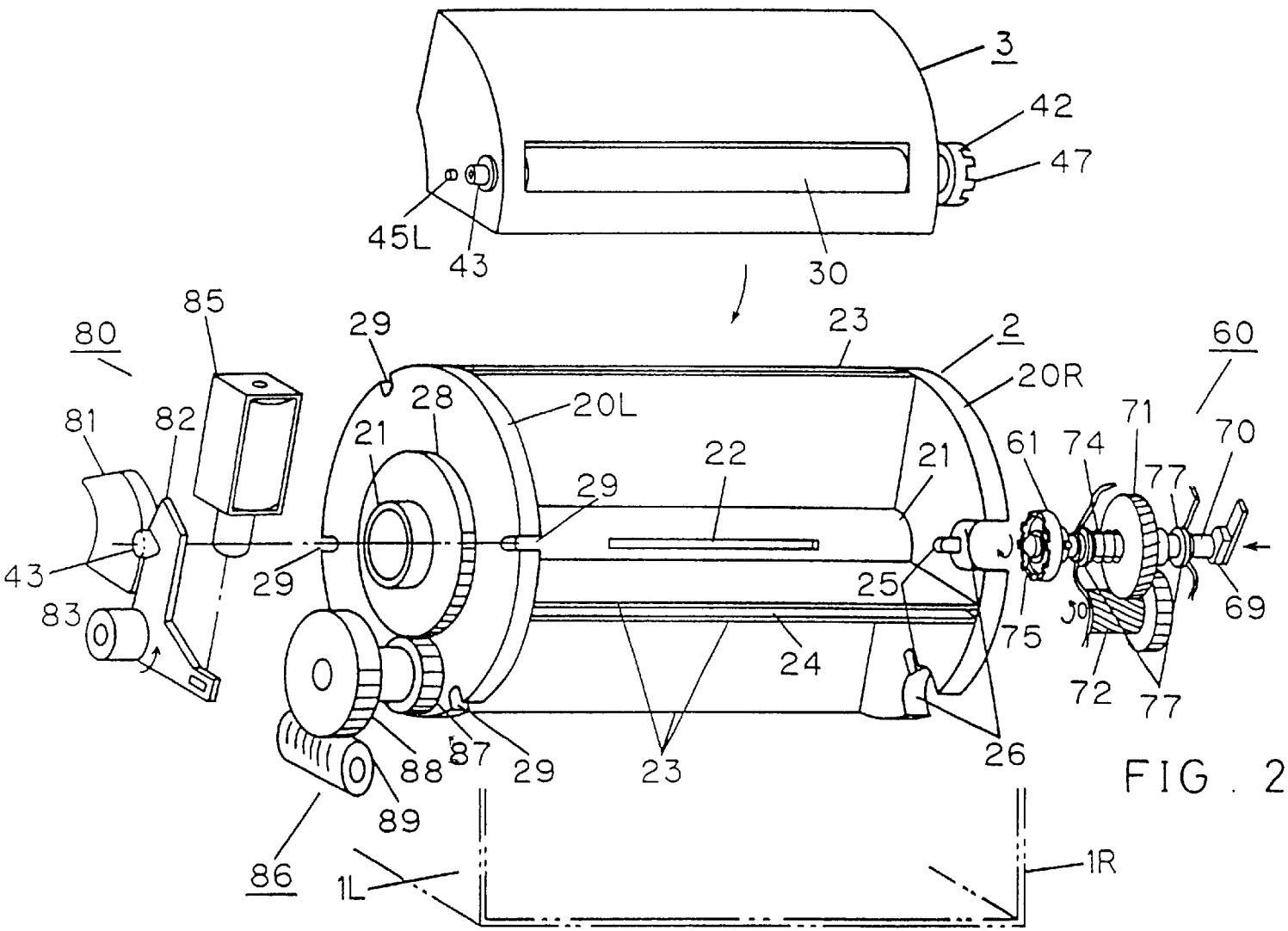
FIG. 2 is a perspective view of a positioning and driving mechanism of a carriage and a photosensitive drum of the color image forming apparatus shown in FIG. 1.

Next, a positioning mechanism and driving mechanism for the photosensitive drum in the image forming position 10 for performing precise registration for each color is explained with reference to FIGS. 2–8. As can be seen in FIG. 2, the carriage 2 has a right wall 20R and a left wall 20L, which are fixed at both ends of the cylindrical shaft 21. There are partition plates 23 for partitioning the image forming unit 3 fixed between these walls 20R and 20L. The partition plates 23 are fixed in four places arranged at equal angular distances around the cylindrical shaft 21. Between each two partition plates 23, an opening 24 is formed, through which the laser beam 8 passes. The cylindrical shaft 21 has eight openings 22. Four of them are openings through which the laser beam 8 enters from the opening 24, and the other four openings are formed such that the laser beam 8, which is reflected by the mirror 19, can leave through the opening.

A coupling plate 42 is fixed to the photosensitive drum 30 of the image forming unit 3, and right cutouts 26 are provided on a portion of the right wall 20R for accepting the coupling plate 42. The right cutouts 26 are provided with recesses, so that the coupling plate 42 and the right wall 20R do not have contact at a regular position. On the outer periphery of the left wall 20L, left cutouts 29 are formed. Each left cutout 29 receives a collar 43 that is provided at the left end of a shaft 40 of the photosensitive drum. The left cutouts 29 are bigger than the outer diameter of the collars 43, so that the collars 43 and the left wall 20L do not have contact at a regular position.

Figure 6:
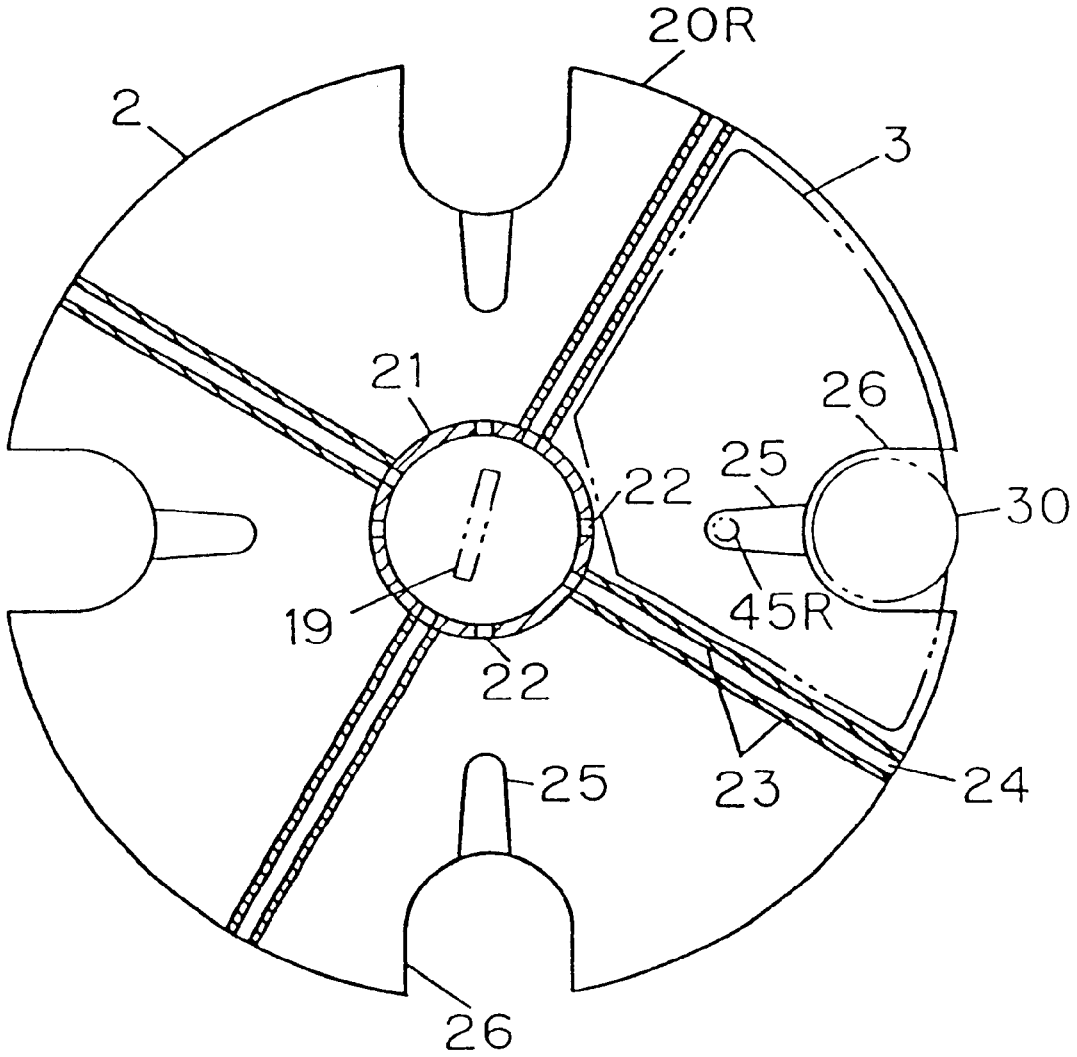
FIG. 6 is a cross section of the carriage showing the positional relationship between an image forming unit and the carriage of the color image forming apparatus shown in FIG. 1.

Guide grooves 25 are formed on the inner side of the right and left walls 20R and 20L. These guide grooves 25 guide a guide pin 45R or 45L provided on one of the two sides of the image forming unit 3, which is thus positioned roughly in the carriage 2. The image forming unit 3 is positioned in the carriage 2 such that the image forming unit 3 can pivot on the guide pins 45R, 45L by a clearance between the coupling plate 42 and the right cutouts 26 or between the collar 43 and the left cutouts 29, as is shown in FIG. 6. In the present example, each clearance mentioned above is set at about 1 millimeter.

When the photosensitive drum 30 is positioned in the image forming position 10, the photosensitive drum 30 is supported by the carriage 2 with a clearance in every direction. To be specific, there are clearances between the guide pins 45R, 45L of the image forming unit 3 and the guide groove 25 of the carriage (especially in the radial direction), and between the outer surface of the image forming unit 3 and the carriage portions.

A mechanism for preventing the image forming unit 3 from dropping out of the carriage 2 is not shown in the figure. This mechanism is provided by using protrusions (not shown in the figure) which protrude inward from the outer periphery of the right and left walls 20R, 20L and which can be easily taken in and out. The image forming unit 3 may be positioned so as to be retained floating in a central position in the carriage 2 (illustrated with a chain line in FIG. 6) by using a spring or other means.

A carriage gear 28 is fixed on the left wall 20L and can be connected to a carriage drive mechanism 86 of the machine body 1. This carriage drive mechanism 86 comprises a worm gear 89 connected to a power source (not shown in the figure), a worm wheel 88 that engages the worm gear 89, and a gear 87 that is integrated with the worm wheel 88 and engages the carriage gear 28. The carriage 2 is rotatably mounted on the right and left main wall 1R, 1L via bearings 46 so that the axis of the carriage 2 is parallel to the laser exposing device 6 and the mirror 19. The mirror 19 is fixed to the right and left main walls 1R, 1L directly by supporting members (not shown in the figure).

Figure 3:
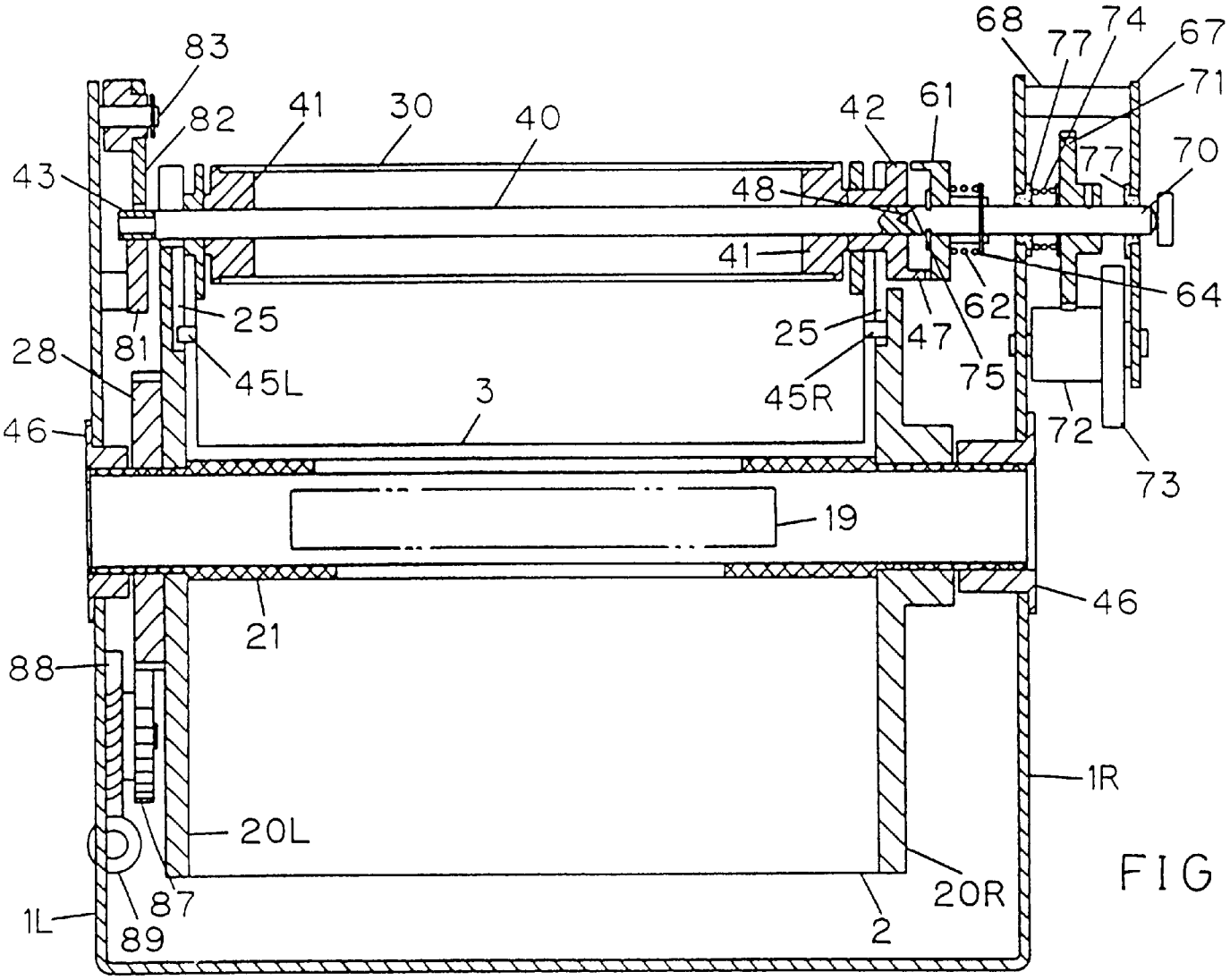
FIG. 3 is a cross section of the carriage of the color image forming apparatus shown in FIG. 1, taken on a plane including the image forming position.
Figure 4:
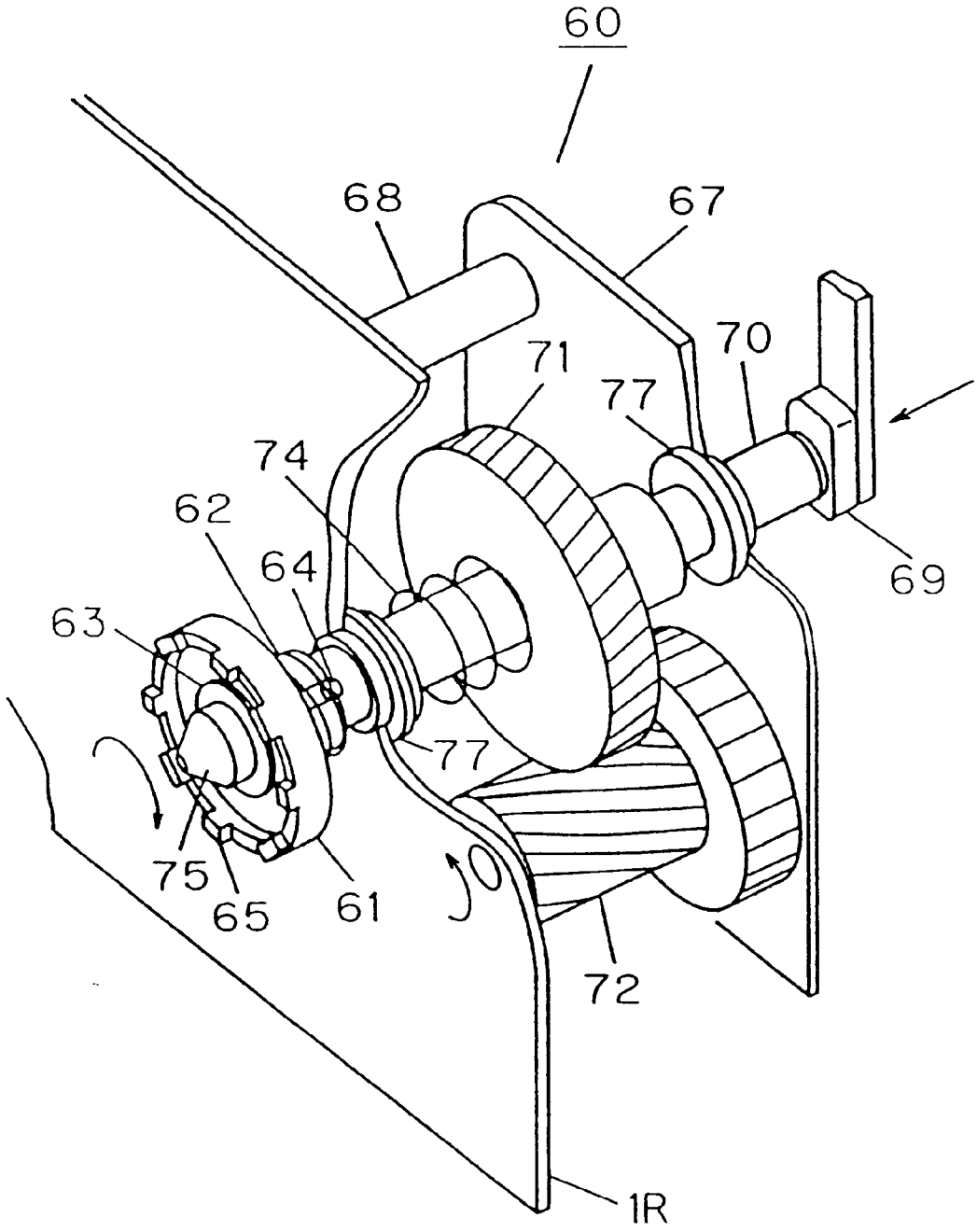
FIG. 4 is a perspective view of a driving mechanism that drives the photosensitive drum of the color image forming apparatus shown in FIG. 1.

The photosensitive drum 30 of the image forming unit 3 has a structure shown in FIG. 3. It comprises a pair of flanges 41 fitted in each end of the photosensitive drum, and the shaft 40 that penetrates the flanges 41. This shaft 40 of the photosensitive drum 30 is rotatably mounted on both side walls of the image forming unit 3. A conical concave surface 48 is formed on the right edge of the photosensitive drum shaft 40. The coupling plate 42 is fixed on the right edge of the shaft 40 and has eight tongues that are disposed in a circle around the shaft and protrude axially. When the coupling plate 42 is rotated, the photosensitive drum shaft 40 and the flanges 41 rotate together, so that the photosensitive drum 30 rotates. The collar 43, which serves as a radial bearing, is attached rotatably on the left edge of the photosensitive drum shaft 40.

Next, the driving mechanism and a detent mechanism for positioning the photosensitive drum precisely at the image forming position, which are employed at the side walls of the machine body 1, are explained.

The driving mechanism 60 of the photosensitive drum 30, which is attached on the right main wall 1R, includes an output shaft 70, a coupling plate 61 that rotates together with the output shaft 70, a driving gear 71 of the output shaft 70, and a power source. The output shaft 70 is supported rotatably and displacably in the axial (thrust) direction by bearings 77 that are fixed to the right main wall 1R and to a base plate 67 disposed in parallel therewith.

The distal end of the output shaft 70 has a convex tapered tip 75. The proximate end of the output shaft 70 has a spherical surface so as to abut on a thrust bearing 69 with little area The driving gear 71, which is fixed to the output shaft 70 for driving the shaft 70, is a helical gear having left helical teeth of the same direction with the rotation of the shaft. This helical gear engages a gear 72 of the power source side, wherein 73 is the driving gear of the gear 72.

A compression spring 74 is inserted between the bearing 77 and the driving gear 71. This spring 74 always applies a force to the output shaft 70 and the coupling plate 61 in the position when the coupling plate 61 and the output shaft 70 are separated from the coupling plate 42 of the photosensitive drum 30 (position indicated in FIG. 4). The output shaft 70 can be moved axially against the force of the compression spring 74 by the drive means that moves the thrust bearing 69, from the separated position (FIG. 4) where the coupling plate 61 of the output shaft 70 is away from the coupling plate 42 of the photosensitive drum 30, to the engaging position (FIG. 3) where the tapered tip 75 of the output shaft 70 engages the conical concave surface 48 of the photosensitive drum shaft 40. The gear 72 of the power source side has a sufficient length in the axial direction so that the output shaft gear 71 engages the gear 72 of the power source side at the separated position as well as the engaging position. When the output shaft 70 is moved along the axial direction, the output shaft drive gear 71 and the power source gear 72 slide against each other on the tooth faces.

The coupling plate 61 engages the coupling plate 42 of the photosensitive drum 30 for transmission of power. This coupling plate 61 has eight coupling tongues 65 that are disposed in a circle around the shaft and protrude axially in the same way as the tongues of the coupling plate 42 of the photosensitive drum 30. The coupling plate 61 is fixed to the rotational output of the output shaft 70 by a pin 64. Furthermore, the coupling plate 61 is movable axially within a predetermined distance. Thus, the coupling plate 61 goes back temporarily when the tips of the coupling tongues 65 abut the tips of the coupling tongues 47. The coupling plate 61 is forced to the distal end of the output shaft 70 by the compression spring 62 and stopped by abutting a stopper 63.

Next, the detent mechanism 80, which is attached to the left main wall 1L, is explained. The detent mechanism 80 comprises a guide plate 81, a detent lever 82 and a solenoid 85 for driving the detent lever 82. The guide plate 81, which is fixed to the left main wall 1L, guides the collar 43 placed at the left end of the photosensitive drum shaft 40 to position the collar at a predetermined radial distance from the center of the carriage 2 when the photosensitive drum is located substantially at the image forming position 10.

The detent lever 82 is pivoted on the left main wall 1L by a pivot pin 83 and pushes the collar 43 to the guide plate 81 with a V-shaped cutout so as to position the collar 43 correctly for the image forming position. The detent lever 82 is connected to the solenoid 85 via a lever 84. The solenoid actuates the detent lever 82 by magnetic force. Consequently, the V-shaped cutout of the detent lever 82 forces the collar 43 to abut the guide plate 81.

The axis that passes the center of the output shaft 70 of the photosensitive drum driving mechanism 60 and the center of the V-shaped cutout of the detent mechanism 80 is parallel to the plane of the mirror 19 as well as the laser exposing device 6 precisely. Clearances of the bearings are minimized. Thus, the image forming unit 30 is usually located precisely at the image forming position 10 when the photosensitive drum driving mechanism 60 and the detent mechanism 80 are actuated.

Figure 7:
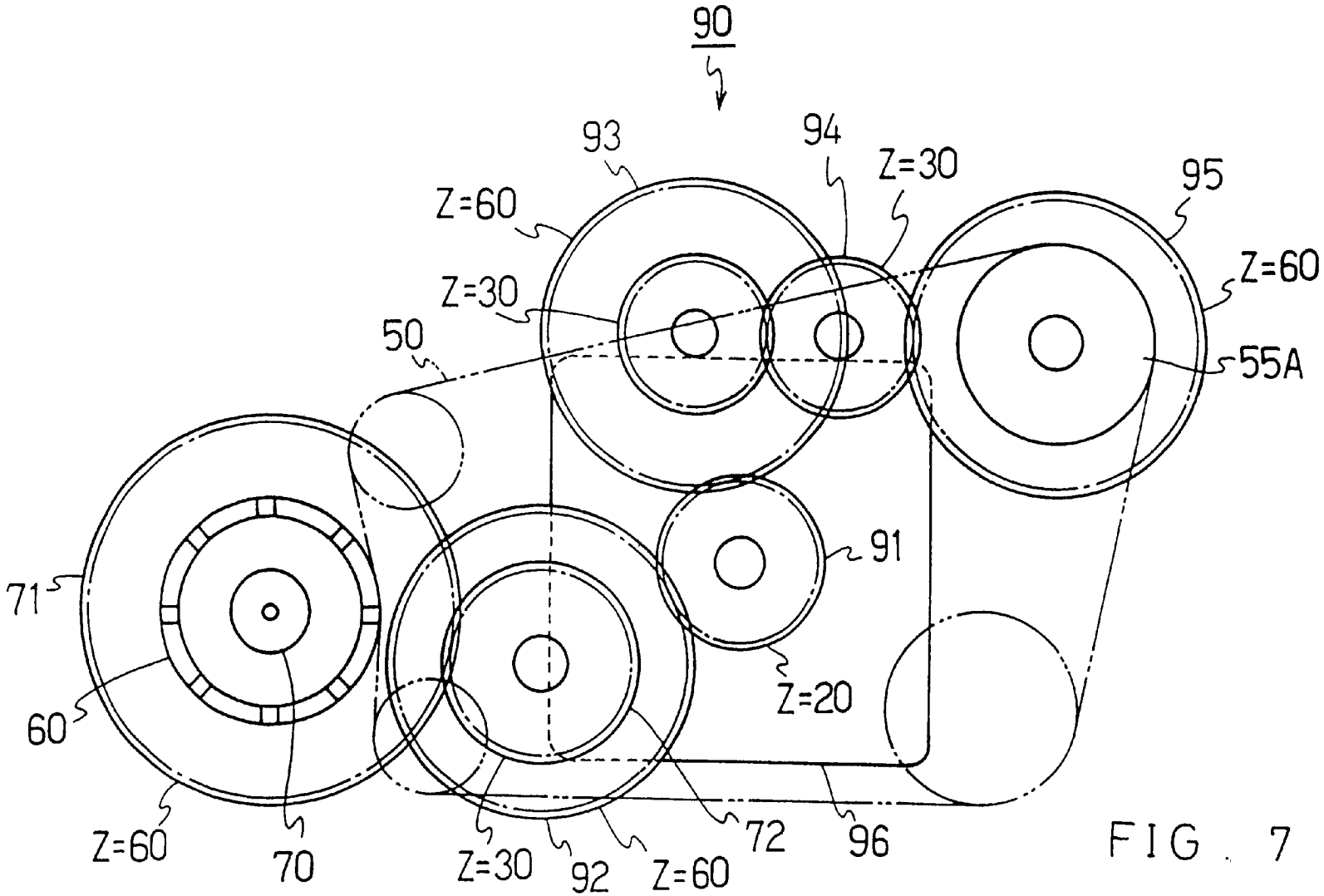
FIG. 7 shows the power transmission of the driving mechanism, taken from the side of the machine body, that drives the photosensitive drum and the intermediate transfer belt of the color image forming apparatus shown in FIG. 1.

Next, a driving mechanism driving the photosensitive drum 30 and the intermediate transfer belt 50 is explained. As shown in FIG. 7, a driving mechanism 90 for driving the photosensitive drum 30 and the intermediate transfer belt 50 includes a motor 96 as a power source and slowdown gears 92, 93 that are connected to the motor 96. The slowdown gear 92 is identical to the power source gear 72 shown in FIG. 4.

A motor gear 91 engages the slowdown gears 92 and 93. When the slowdown gear 93 is installed on the transfer belt unit 5, the slowdown gear 93 engages a gear 94, which engages a pulley gear 95 fixed to the drive pulley 55A. The slowdown gear 92 engages the output shaft drive gear 71 to drive the photosensitive drum 30. The rotation ratios among these gears are all integers.

An outer diameter of the drive pulley 55A is 30 millimeters and a perimeter of the intermediate transfer belt is 377 millimeters. Four turns of the drive pulley 55A corresponds to just one turn of the intermediate transfer belt 50. The rotation ratio of the pulley gear 95, which is connected to the drive pulley 55A, to the slowdown gear 93 is 1:2, and that of the slowdown gear 93 to the motor gear 91 is 1:3. An outer diameter of the photosensitive drum 30 is also 30 millimeters. Four turns of the photosensitive drum 30 correspond to just one turn of the intermediate transfer belt 50, so that the photosensitive drum 30 is synchronized with the drive pulley 55A. The rotation ratio of the output shaft drive gear 71 to the slowdown gear 92 is 1:2, and that of the slowdown gear 92 to the motor gear 91 is 1:3.

In the present example, the outer diameter of the guide pulley 55C of the transfer belt unit 5 is 20 mm, and the rotation ratio of the guide pulley 55C and the intermediate transfer belt 50 is an integer. It is preferable that the rotation ratios of the backup roller 55B and the tension roller 55D also are integers.

Figure 8:
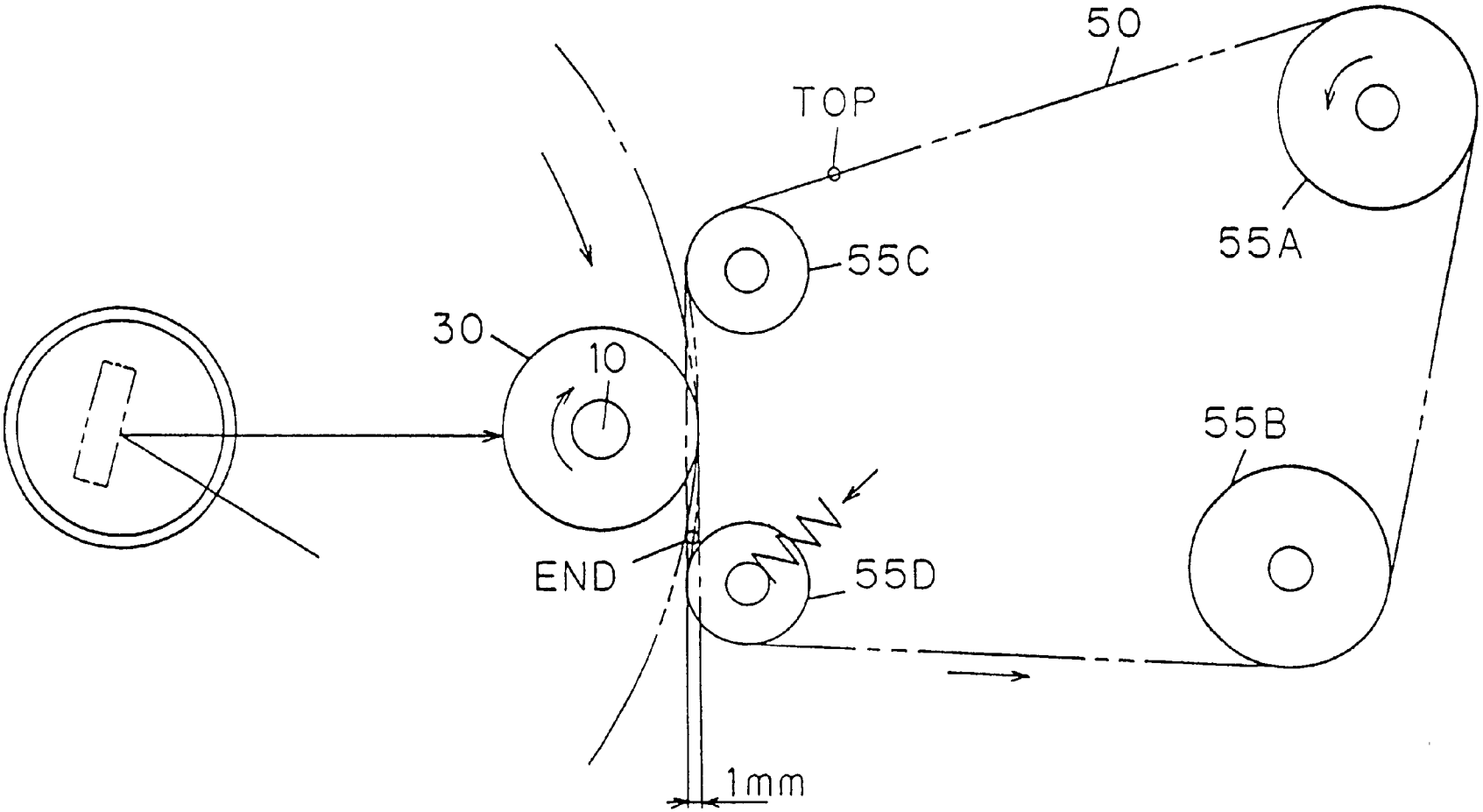
FIG. 8 is a cross section showing the positional relationship between the photosensitive drum and the intermediate belt of the color image forming apparatus shown in FIG. 1.

Next, the relationship between the photosensitive drum 30 in the image forming position 10 and the intermediate transfer belt 50 is explained. FIG. 8 shows an arrangement of the photosensitive drum located at the image forming position 10 and the intermediate transfer belt 50. When the transfer belt unit 5 is placed correctly between the right and left main walls 1L, 1R, the perimeter of the photosensitive drum 30 located at the image forming position 10 crosses the tangent line of the guide roller 55C and the tension roller 55D by about one millimeter, as shown in FIG. 8. Therefore, the tension of the intermediate transfer belt 50 generates a constant pressure of the belt 50 against the peripheral surface of the photosensitive drum 30. Thus, uniform contact between the intermediate transfer belt 50 and the photosensitive drum 30 is obtained. In an example, a satisfactory performance for the image transfer was obtained by applying a spring force of 2–3 kilograms onto the tension roller 55D in the direction indicated by the arrow in FIG. 8. In this example, the width of the intermediate transfer belt 50 was 250 millimeters.

When the carriage 2 rotates for changing the image forming unit 3 located at the image forming position 10, the image forming unit 3 may move into and out of the image forming position 10 while rubbing the surface of the intermediate transfer belt 50. In this embodiment, however, the intermediate transfer belt rotates one turn per every image transfer for each color and usually stops in a predetermined position. Therefore, there is an imageless area between the beginning and the end of the image, where there is no image formed on the intermediate transfer belt 50. Therefore, no image distortion occurs due to the color change. If the surface of the belt 50 is lightly damaged due to abrasion at the imageless area, the transferred image is not affected.

When the photosensitive drum driving mechanism 60 actuates the photosensitive drum 30, the image forming unit 3 in the carriage 2 can protrude about 0.5–1.0 mm in direction of the intermediate transfer belt 50. In this case, when the photosensitive drum driving mechanism 60 is disconnected from the image forming unit 3, the photosensitive drum 30 and the intermediate transfer belt 50 can be separated. Consequently, when the carriage 2 is moved in this condition, the photosensitive drum 30 does not abrade the surface of the intermediate transfer belt 50, and damage of the intermediate transfer belt can be reduced.

Next, the operation of an apparatus with a driving mechanism as pointed out above is explained. Details concerning the installation of the image forming units 3 into the carriage 2, and the initialization procedure of the photosensitive drum 30 and the intermediate transfer belt 50 are not included in this explanation.

When all image forming units 3 are installed in the carriage 2, a motor (not shown in the drawings) for driving the carriage 2 rotates the worm gear 8. Then the carriage 2 turns in the direction of the arrow in FIG. 1, so that the yellow image forming unit 3Y is moved to the image forming position 10. The output shaft 70 of the photosensitive drum driving mechanism 60 is forced to move backwards by the spring 74. The tapered tip 75 of the shaft 70 and the coupling plate 61 are away from the coupling plate 42 of the photosensitive drum 30.

Figure 5:
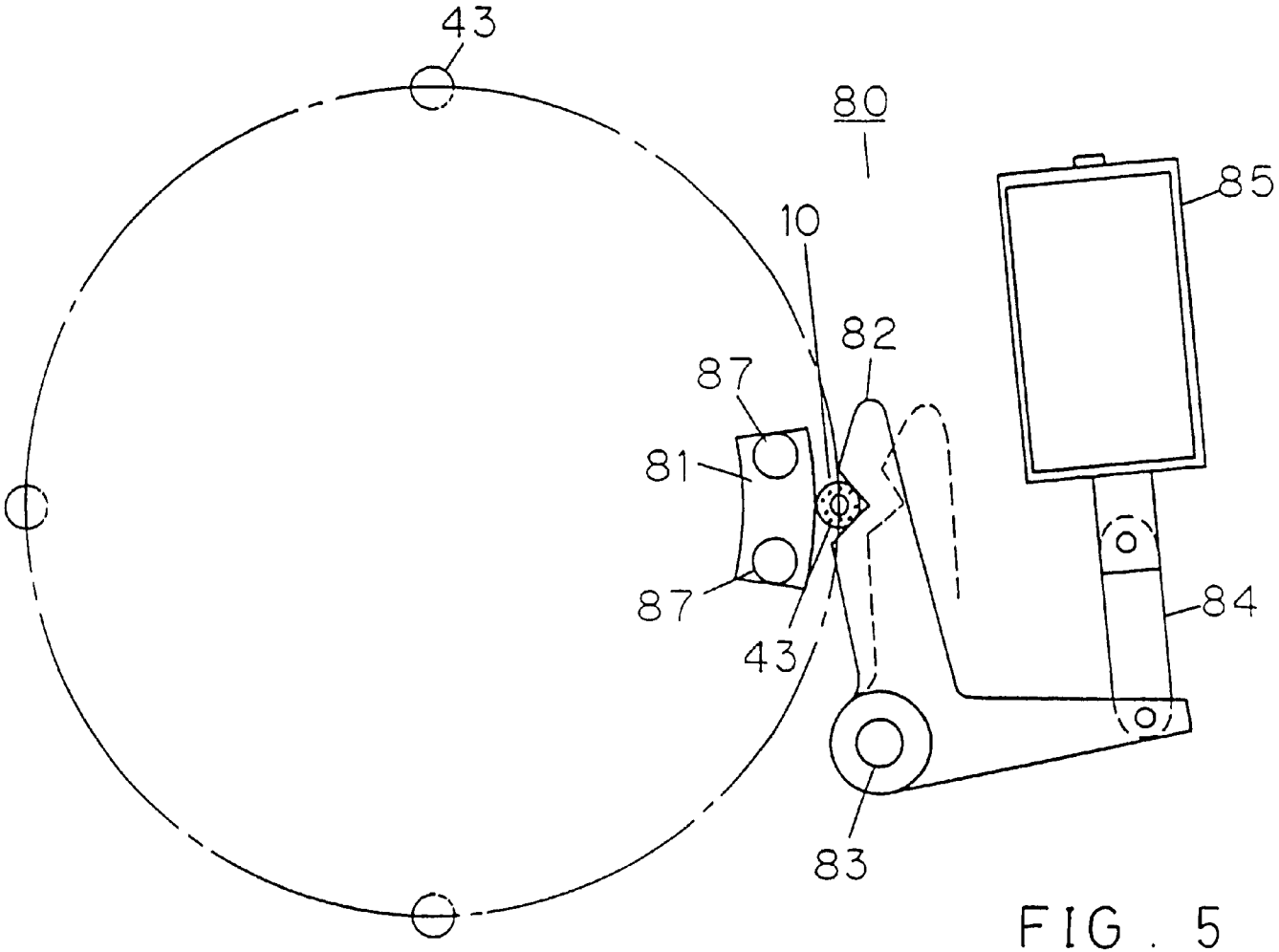
FIG. 5 is a side view of a mechanism for positioning the axis of the photosensitive drum of the color image forming apparatus shown in FIG. 1.

The solenoid 85 of the detent mechanism 80 is not activated, and the detent lever 82 is in a waiting position, as is illustrated with a broken line in FIG. 5. The motor 96, which drives the photosensitive drum 30 and the intermediate transfer belt 50, is stopped. The yellow photosensitive drum 30 is moved near the image forming position while rubbing the intermediate transfer belt 50, when the motor for driving the carriage stops. Consequently, the worm gear 89 stops rotating, so that the carriage 2 is locked at this position.

When the carriage 2 stops, the solenoid 85 is actuated at once, so that the detent lever 82 forces the collar 43 of the photosensitive drum shaft 40 towards the guide plate 81. Consequently, the V-shaped cutout of the detent lever 82 grips the collar 43 at the predetermined position. Simultaneously, the thrust bearing 69 pushes the output shaft 70 leftward in FIG. 3 against the spring force. The tapered tip 75 of the output shaft 70, while being pushed leftward, starts to engage the conical concave surface 48 of the photosensitive drum shaft 40. Thus, the tapered tip 75 of the output shaft 70 is moved to align the two axes of the photosensitive drum shaft 40 and the output shaft 70. The alignment of two axes of the photosensitive drum shaft 40 and the output shaft 70 is completed and the photosensitive drum 30 is positioned precisely at the image forming position 10 when the tapered tip 75 has engaged the conical concave surface 48, and the thrust bearing 69 pushes the output shaft 70.

At this time, the thrust force on the output shaft 70 is received by the edge surface of the flange 41 pushing a side bearing of the image forming unit 3, with this side bearing abutting the left wall 20L of the carriage 2. When the tapered tip 75 engages the conical concave surface 48, the two coupling plates 42 and 61 engage each other, so that a rotation force can be transmitted to the photosensitive drum 30.

As mentioned above, the yellow photosensitive drum 30 is positioned correctly by the detent mechanism 80 and the drive mechanism 60. Moreover, the whole body of the image forming unit 3Y, which includes the photosensitive drum 30, is moved in the carriage 2 for positioning. However, since the image forming unit 3 is retained in the carriage 2 with some clearance, the movement of the image forming unit 3 is not disturbed during the positioning of the photosensitive drum 30.

Although the carriage 2 has some clearance in the rotation direction such as a backlash between the carriage gear 28 and the gear 87, the clearance of the carriage 2 does not effect the positioning of the photosensitive drum 30, since the photosensitive drum 30 is positioned directly by the mechanism attached to the machine body, so that the photosensitive drum 30 can be precisely positioned.

After the positioning of the photosensitive drum 30 is completed, the motor 96 for driving the belt starts to turn. When the photosensitive drum 30 and the intermediate transfer belt 50 start to turn, all the process devices begin their operation and the yellow toner image subsequently is formed on the photosensitive drum 30. Then, the yellow toner image is transferred onto the intermediate transfer belt 50. During this operation, the output shaft 70 is forced leftward in FIG. 2 by the thrust bearing 69, and the solenoid 85 maintains an actuated state so that the detent lever 82 continues to retain the collar 43.

After the intermediate transfer belt 50 has rotated one turn (at this time, the photosensitive drum 30 and the drive pulley 55A have rotated four turns, and the guide pulley 55C has rotated six turns) the yellow image forming is completed. The motor 96 stops and the intermediate transfer belt 50 stops at the initializing position. After the intermediate transfer belt 50 and the photosensitive drum 30 stop, the solenoid 85 is turned off to release the detent. At the same time, the thrust bearing 69 retreats rightward in FIG. 2, and the output shaft 70 also retreats due to the spring force. Consequently, the coupling plate 61 and the tapered tip 75 separate from the coupling plate 42 and the photosensitive drum shaft 40, so that the carriage becomes ready to rotate.

After the coupling is released, the worm gear 89 starts rotating again, the carriage 2 is rotated in the direction of the arrow in FIG. 2, and the magenta image forming unit 3M moves near the image forming position 10. The detent mechanism 80 and the drive mechanism 60 for the photosensitive drum operate again to position the magenta photosensitive drum 30 and to perform coupling. Thus, the image forming for the second color toner image starts.

A four-colored image can be formed on the intermediate transfer belt 50, repeating the image forming of each color by changing the image forming unit of each color as explained above. The four-colored image formed on the intermediate transfer belt 50 is finally transferred onto a recording paper sheet. In an example, the time period for rotating the carriage by 90 degrees is 0.6 seconds, the time period for engagement or release of the coupling is 0.2 seconds, and the process velocity is 100 millimeters per second.

Next, the positioning for overlaying the plural color toner image is explained. It is important that both of the photosensitive drum 30 and the intermediate transfer belt 50 rotate accurately at a constant speed in order to ensure precise positioning of the plural color toner images. To realize this precise registration, a FG servo motor is used as the motor 96 for driving the photosensitive drum 30 and the intermediate transfer belt 50 in this embodiment, and to suppress load variations, the motor 96 is used exclusively for this purpose. In addition, to match the home position of the image formed on the intermediate transfer belt 50, recording of each color is performed after the motor 96 has been started and reached a certain constant speed. Then, the home position of the intermediate transfer belt 50 is detected, and a synchronized latent image recording by the laser signal beam 8 onto the photosensitive drum 30 is started.

It is also necessary that the four photosensitive drums 30 are located and retained accurately at the image forming position 10 to ensure precise positioning. As mentioned before, positioning of the photosensitive drum 30 in this embodiment is performed by the output shaft 70 and the detent lever 82, which are attached to the right and left walls 1R, 1L and support the photosensitive drum shaft directly. The photosensitive drum 30 is movable within a predetermined clearance in the carriage 2, so that the carriage 2 only has to be positioned roughly, and the photosensitive drum 30 can be positioned precisely and independently from the positioning accuracy of the carriage 2.

It is also necessary to rotate the precisely positioned photosensitive drum 30 at a precise speed. In order to change the photosensitive drum 30, a clutch mechanism between the photosensitive drum 30 and the driving mechanism on the machine body is necessary. When the clutch includes gears such as are usually used, variations in the transmission of a clutch (coupling) portion can occur, and the photosensitive drum 30 cannot be precisely rotated. Especially, when the four photosensitive drums are not used equally, and the toner in one image forming unit 3 is used up, it becomes necessary to exchange this image forming unit 3, and variations in the precision of the coupling portion of the photosensitive drum 30 are likely to occur. Consequently, a coupling mechanism that might influence the precision of the positioning of the photosensitive drum 30 cannot be used.

In the present embodiment however, the configuration explained above is used, wherein the photosensitive drum 30 is rotated while being held by the output shaft 70. Consequently, a variation in the angular velocity transmitted between the output shaft 70 and the photosensitive drum 30 cannot occur, and the angular velocity is transmitted precisely from the output shaft 70 to the photosensitive drum 30. Therefore, it is not required to use coupling members for the photosensitive drum 30 that have precise dimensions.

Errors of rotation speeds or angular speeds, which appear in the transmission system of the machine body side between the motor 96 and the output shaft 70 or the intermediate transfer belt 50, are eliminated by selecting integer ratios for each rotation ratio of each gear 91–95 and 71, the drive pulley 55A or the guide pulley 55C vs. one turn of the intermediate transfer belt 50. According to the above mentioned configuration, these elements return to the initializing position after every color image transferring, and repeat their operation under the same conditions. Thus, a displacement from the ideal recording position in the case of driving with an ideal constant speed happens always in the same amount and phase for all colors, so that the recording positions of all colors are perfectly matched, and color misregistration on the intermediate transfer belt 50 is eliminated.

When the photosensitive drum 30 has portions that are eccentric with respect to the center of the conical concave surface 48, which is the rotational center of the photosensitive drum 30, this leads to a variation of the circumferential speed of the photosensitive drum 30. Consequently, the recording pitch changes, and if the amount and phase of eccentricity for the various photosensitive drums 30 is different, position displacement of the colors occurs. Therefore, in the present embodiment, the intermediate transfer belt 50 is pressed lightly against the photosensitive drum 30 by its own tensile force, as has been explained above, and is driven at a constant speed, regardless of the outer peripheral velocity of the photosensitive drum 30. Consequently, due to slippage between the photosensitive drum 30 and the intermediate transfer belt 50, when the outer peripheral velocity of the photosensitive drum 30 is higher the velocity of the intermediate transfer belt 50, the portion that has been recorded with an elongated recording pitch is transferred onto the intermediate transfer belt 50 with compression, and in the reverse case with elongation. As a result, the toner image for each color can be transferred precisely with a recording pitch corresponding to the angular speed, regardless of the outer peripheral speed of the photosensitive drum 30.

Second Embodiment

Next, a color image forming apparatus according to a second embodiment of the present invention is explained. This embodiment differs from the first embodiment, in that the rotation direction of the carriage is set in an opposite direction, and that the intermediate transfer belt also can be driven in an opposite direction.

Figure 9:
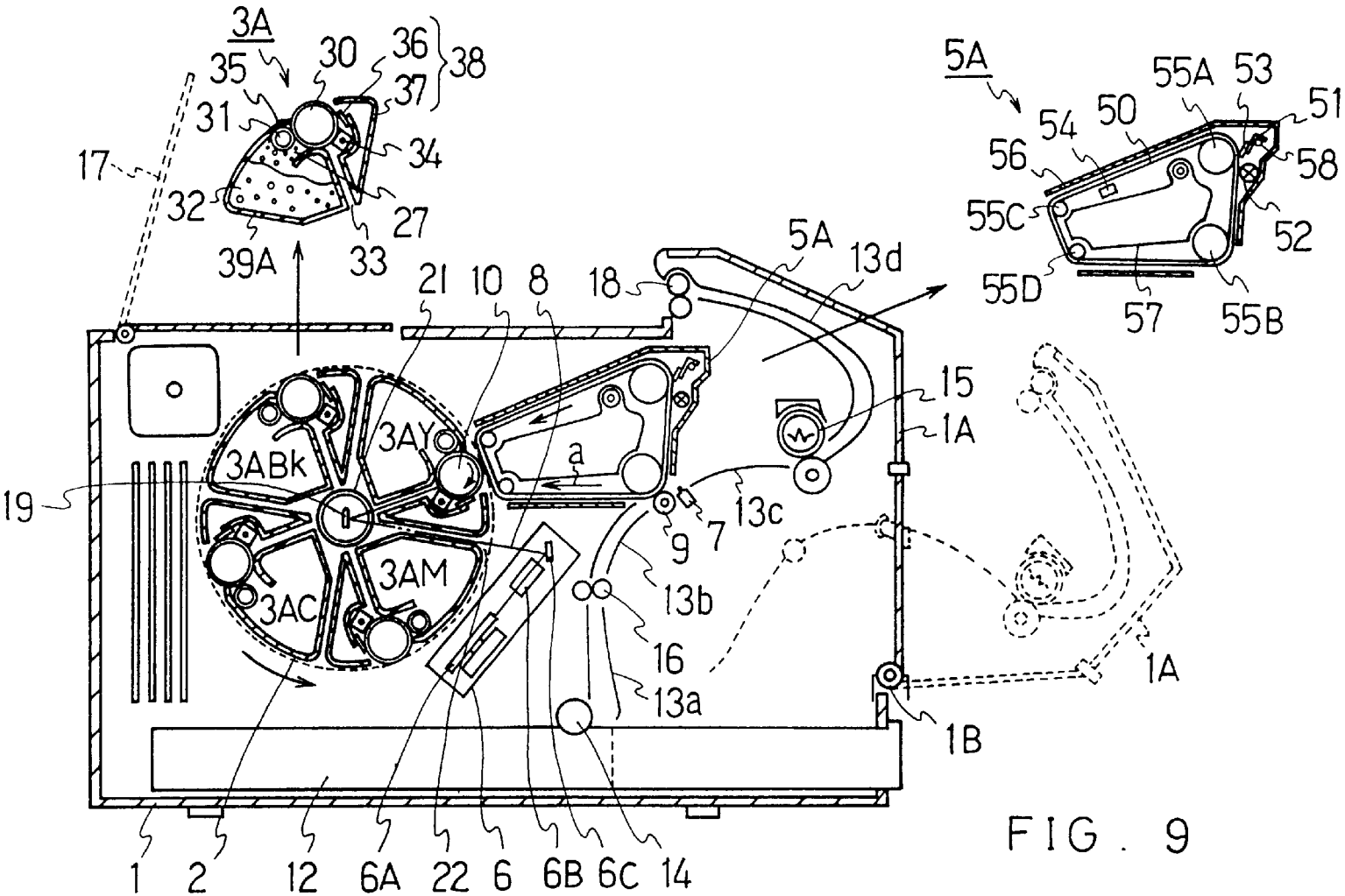
FIG. 9 is a cross section of a second embodiment of the color image forming apparatus according to the present invention, showing the inner structure in a side view.

The operation of a color image forming apparatus according to the second embodiment of the present invention is explained with reference to FIG. 9. After the yellow image formation using a yellow image forming unit 3AY has been completed, the yellow image forming unit 3AY is exchanged with a magenta image forming unit 3AM. Synchronized with the separation of the photosensitive drum driving mechanism 60 from the photosensitive drum 30, the driving source of the intermediate transfer belt 50 of the intermediate transfer belt unit 5A is driven in reverse rotation.

The length of the intermediate transfer belt 50 is 378 mm and thus a little longer than A4 paper length (297 millimeters) plus half the perimeter of the photosensitive drum plus some addition, as has been described above. Consequently, in the difference between the length of the intermediate transfer belt 50 and an A4 paper length, a shifting distance (measuring about half the perimeter of the photosensitive drum 30) for the photosensitive drum 30 from the photosensitive drum 30 to the transfer position is included.

Considering the start-up time from starting the motor 96 until the motor runs at a perfectly constant velocity, and the shut-down time from stopping the motor 96 until the motor has come to a complete stop, the imageless area on the intermediate transfer belt 50 should be as long as possible. However, when the length of the intermediate transfer belt 50 is too long, the time required to perform one revolution of the intermediate transfer belt 50 becomes too long, so that this time has to be added to the time required to perform an image formation.

In order to make the length of the intermediate transfer belt 50 small, the imageless area can be made small by rotating the intermediate transfer belt 50 in the reverse direction while the photosensitive drum driving mechanism 60 is disconnected. Consequently, the time necessary to perform image formation is shortened, and a speedier print-out becomes possible, because the length of the intermediate transfer belt 50 has been shortened.

However, the operation of rotating the intermediate transfer belt 50 in reverse is performed after the photosensitive drum driving mechanism 60 has been separated from the photosensitive drum 30, so that the photosensitive drum 30 is not rotated in reverse by error. That means, that the motor 96 may not be operated when the photosensitive drum driving mechanism 60 is connected to the photosensitive drum 30.

If the intermediate transfer belt 50 rotates reversely in the arrow direction "a" while the image forming unit 3A is shifted by the rotation of the carriage 2, then the sliding of the photosensitive drum 30 and the intermediate transfer belt 50 during the shifting time of the image forming unit 3A is small, so that the damage inflicted on the intermediate transfer belt 50 can be kept small.

Even if some minor damage occurs, this does not pose a problem for the image formation, because the position where the photosensitive drum 30 and the intermediate transfer belt 50 rub onto each other!is in the imageless area of the intermediate transfer belt 50. However, in order to prolong the life expectancy of the intermediate transfer belt 50, it is preferable also to avoid rubbing between the photosensitive drum 30 and the imageless area as much as possible.

A configuration has been adopted, wherein the toner 32 in the toner hopper 39 accumulates in a toner gatherer 27 in the developing device 35 when carriage 2 is rotated in order to provide enough toner 32 to the developing roller 31 of the image forming unit 3A in the image forming position 10. To be specific, one side of the toner gatherer 27 is made bigger, so that the capacity of the toner gatherer 27 becomes bigger. Therefore, even when a one-colored image formation process is performed successively, the frequency of the toner supplying operation, which involves stopping the image formation and rotation of the carriage 2 to provide the developing roller 31 with toner 32, can be reduced.

Third Embodiment

Figure 10:
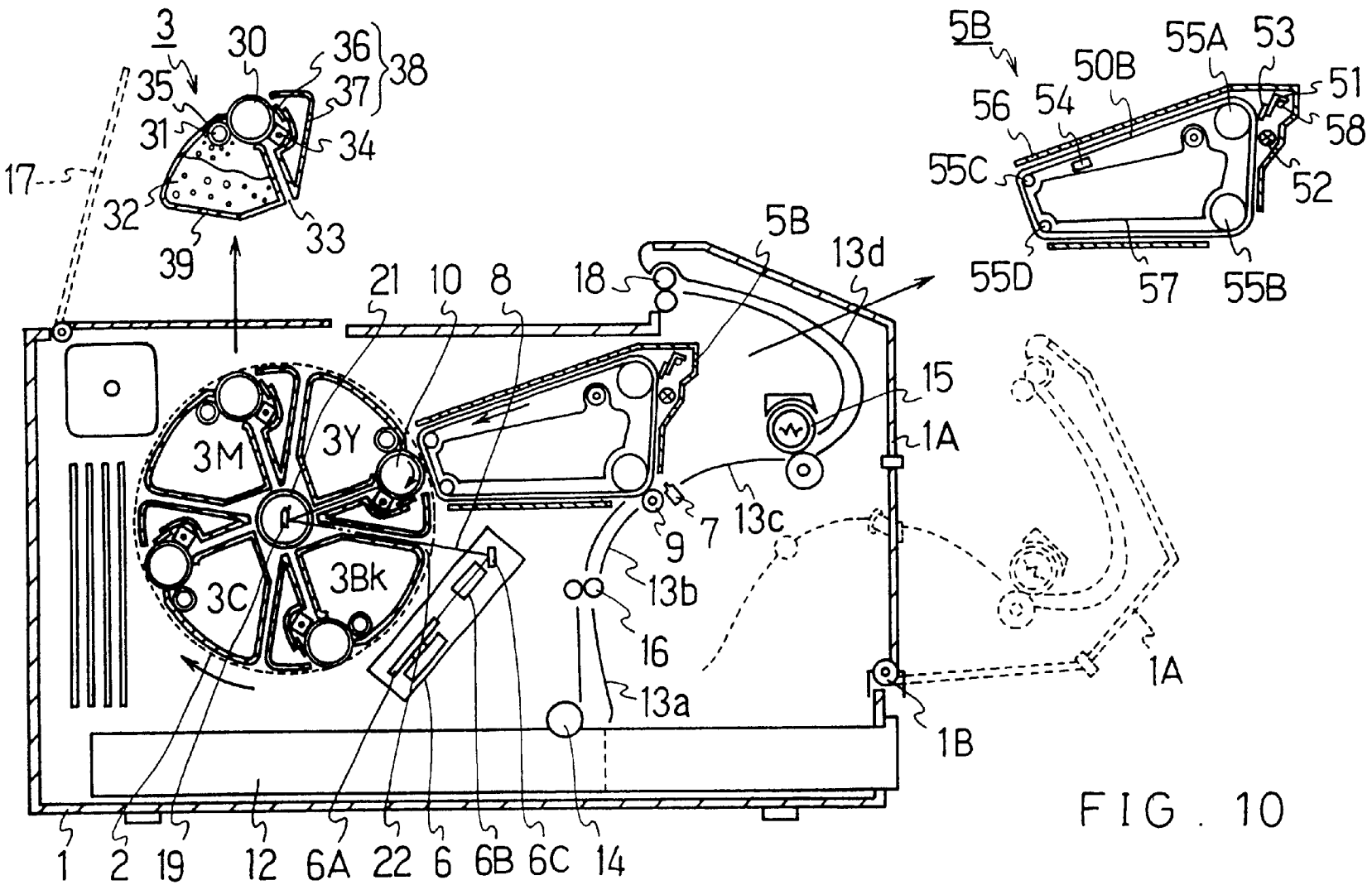
FIG. 10 is a cross section of a third embodiment of the color image forming apparatus according to the present invention, showing the inner structure in a side view.
Figure 11:
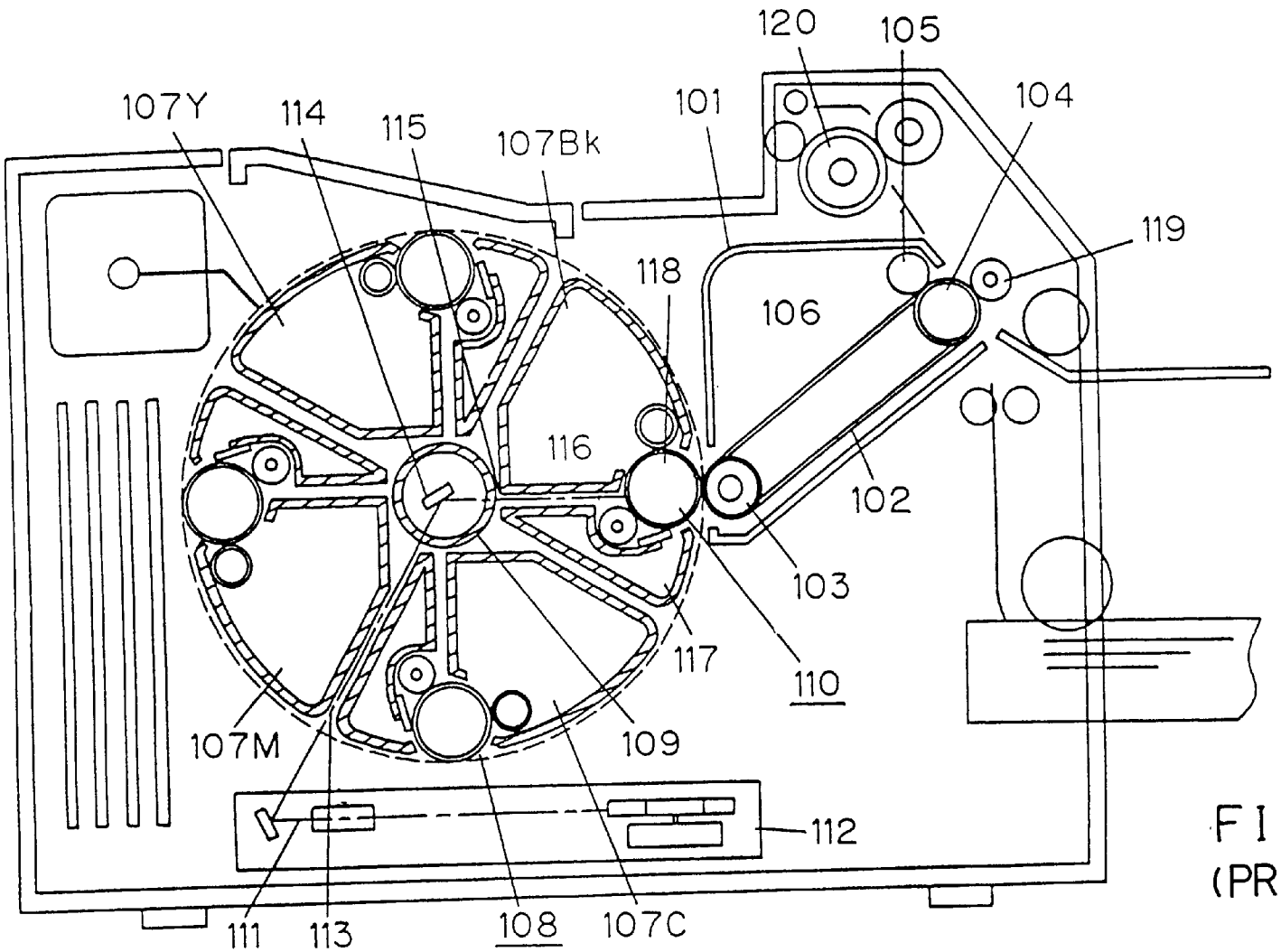
FIG. 11 (PRIOR ART)
FIG. 11 is a cross section of a color image forming apparatus of the prior art showing the inner structure in a side view.

Next, a color image forming apparatus according to a third embodiment of the present invention is explained. As can be seen in FIG. 10, the intermediate transfer belt 50 of this embodiment is longer than in the abovementioned embodiments. Furthermore, the gear ratio of the driving gears is set so that the ratio of the rotation periods of the photosensitive drum 30 and the intermediate transfer belt 50 is an integer.

The intermediate transfer belt unit 5B of a color image forming apparatus according to this embodiment uses a 472 mm long endless belt as an intermediate transfer belt 50B. There are two kinds of image forming modes, namely a high speed mode and a high image quality mode. When the initializing operation is completed, and after the preparation for image formation has been finished, a judgement is performed as to which of the two modes has been selected. The high speed mode is performed with basically the same operations as described in the first embodiment. The high quality mode is explained in the following.

In the full color image formation process using the high quality mode, first, the yellow image forming unit 3Y is moved into the image forming position 10, and an image formation process using the yellow image forming unit 3Y is performed. When the yellow photosensitive drum 30, which is connected to the driving power source of the machine body 1, starts to rotate in the image forming position 10, the developing device 35 and the intermediate transfer belt 50B start to move simultaneously. Then, recording paper is fed by the paper feed roller 14 from the paper feed unit 12. The cleaning blade 53, which has been pressing onto the intermediate transfer belt 50B so far, is separated from the intermediate transfer belt 50B. Then, the secondary transfer roller 9 is separated from the intermediate transfer belt 50B.

0.1 sec after the driving source has started the rotation, a charging voltage is applied to the charger 34, which begins the charging operation. The surface of the photosensitive drum 30 is charged by the charger 34, and when an even charge is starting to be applied, the photosensitive drum 30 makes at least one full rotation. Then, matched with the time when the starting position for charging the surface of the photosensitive drum 30 comes into the exposing position again, the position sensor 54 detects the home position of the intermediate transfer belt 50B. The laser signal beam 8, which is output from the laser exposing device 6 according to an image signal, is synchronized with this detection signal. The evenly charged photosensitive drum 30 is irradiated by the laser signal beam 8, and a static latent image is formed according to the image signal. This static latent image is subsequently made manifest by developing device 35, and a toner image is formed.

Then, the toner image formed on the photosensitive drum 30 is moved to a primary transfer position contacting the intermediate transfer belt 50B, and is subsequently copied onto the intermediate transfer belt 50B. The above operation is continued for a A4-sized image, and after the end of the image has been transferred to the intermediate transfer belt 50B, the yellow image formation process is finished. After this, the photosensitive drum 30 and the intermediate transfer belt 50B are moved to an initialization position.

Then, same as in the high speed mode, the charger 34 charges the photosensitive drum 30 at −450 volts. The exposing voltage of the photosensitive drum is −50 volts. DC potential of +100 volts is applied to the developing roller 31 when a portion of the photosensitive drum 30, which is not charged yet, passes the developing roller. Then, 0.3 sec after the driving source has begun the rotation, the evenly charged surface of the photosensitive drum 30 passes the developing roller, and DC potential of −250 volts is applied to the developing roller 31. Synchronized with the detection signal output from the position sensor 54 of the intermediate transfer belt 50B, a DC voltage of +1.0 kilovolts is applied to the guide pulley 55C and the tension pulley 55D of the intermediate transfer belt 50.

The driving mechanism of the machine body 1 releases the coupling with the photosensitive drum 30 when the photosensitive drum 30 and the intermediate transfer belt 50B stop after the yellow image formation is completed. Then, the carriage 2 rotates 90 degrees in the arrow direction, so that the yellow image forming unit 3Y moves away from the image forming position 10 and the magenta image forming unit 3M moves to the image forming position 10. When the magenta image forming unit 3M stops at the image forming position 10, the driving mechanism of the machine body 1 engages the magenta photosensitive drum 30. Then the magenta image forming unit 3M and the transfer belt unit 5 start to operate for magenta image formation. Similar operations are performed as for yellow image formation, so that the magenta toner image is formed overlaying the yellow toner image on the intermediate transfer belt 50B.

The above operation is repeated in order for cyan and black, so that a four-colored toner image is formed on the intermediate transfer belt 50B. When the black toner has been transferred, the toner image comes to the position of the secondary transfer roller 9, and about 1.4 sec after the generation of the next detection signal from the position sensor 54, the top of the image again comes to the position of the secondary transfer roller 9, and 0.2 sec before that, the secondary transfer roller 9 approaches the intermediate transfer belt 50B. Simultaneously, a recording paper sheet is fed from the paper feed unit 12 and further fed while being held between the secondary transfer roller 9 and the intermediate transfer belt 50B, while the timing is checked with the resist roller 16. Thus, the four-colored toner image as a whole is transferred onto the recording paper sheet. At this time, a DC voltage of +300 volts is applied to the secondary transfer roller 9. The recording paper onto which the toner image has been transferred passes through the fixing device 15 that fixes the toner image. Then, the paper sheet is ejected by the ejecting roller 18.

The remaining toner on the intermediate transfer belt 50B is wiped off after the second transfer by the cleaning blade 53 that contacts with the intermediate transfer belt 50B. The wiped toner is collected into the waste toner container 57 with the screw 52. Because the cleaning blade 53 is spaced away from the intermediate transfer belt 50B while the color image is formed, the cleaning blade 53 is put into contact with the intermediate transfer belt 50B to clean the surface of the intermediate transfer belt 50B. This contacting time is after the secondary transfer onto the recording paper has been completed.

After finishing the second transferring and the cleaning of the intermediate transfer belt 50B, the intermediate transfer belt 50B and the image forming unit 3 are stopped again. Then the carriage 2 rotates 90 degrees so that the yellow image forming unit 3Y moves to the image forming position 10 again. Thus, the color image formation is completed.

Thus, the first point in which the high image quality mode differs from the high speed mode is that the exposure for image formation begins after the photosensitive drum 30 has been rotated for at least one revolution following the start of the charging of the photosensitive drum 30. Usually, at the time when the charging is started, the electric potential of the photosensitive drum 30 is unstable, and this instability can be a factor for deterioration of the quality of the formed image. In the present embodiment, the electric potential of the photosensitive drum 30 is stabilized by rotating the photosensitive drum 30 for at least one revolution after the start of the charging, so that the instability of the electric potential of the photosensitive drum 30 is eliminated, and a higher picture quality can be obtained for the formed image.

The second point in which the high image quality mode differs from the high speed mode is that the secondary transfer roller 9 and the intermediate transfer belt 50B are kept apart from each other during the latent image formation by exposure of the photosensitive drum 30 and the transfer of the toner image onto the intermediate transfer belt 50B. When the secondary transfer roller 9 is disconnected from the intermediate transfer belt 50B, the rotational load of the intermediate transfer belt 50B changes, and the conveyance velocity of the intermediate transfer belt 50B may easily vary. In the position in which the toner image is transferred from the photosensitive drum 30 to the intermediate transfer belt 50B, the photosensitive drum 30 and the intermediate transfer belt 50B are in contact. Therefore, there is the possibility that a change in the velocity of the intermediate transfer belt 50B causes a change in the velocity of the photosensitive drum 30. In the high quality image mode of the present embodiment however, the secondary transfer roller 9 and the intermediate transfer belt 50B are kept apart from each other during the image formation and the transfer of the toner image onto the intermediate transfer belt 50B. Thus, a stable conveyance of the intermediate transfer belt 50B is realized, and a higher picture quality can be obtained for the formed image.

The third point in which the high image quality mode differs from the high speed mode is that the paper feed of recording paper from the paper feed unit 12 and the conveyance operation of the paper by the resist roller 16 is not performed during the latent image formation by exposure of the photosensitive drum 30 and the transfer of the toner image onto the intermediate transfer belt 50B. Especially at the start of the paper feed operation a big torque is necessary, which may cause the machine body 1 to vibrate. There are cases where the adoption of a structure for the machine body 1 that is sufficiently resistant to resonance is limited due to cost and weight considerations. In the high image quality mode of the present embodiment however, the paper feed operation is not performed during the image formation and the transfer of the toner image onto the intermediate transfer belt 50B. Thus, a higher picture quality can be obtained for the formed image.

The fourth point in which the high image quality mode differs from the high speed mode is that the cleaning blade 53 and the intermediate transfer belt 50B are kept apart from each other during the latent image formation by exposure of the photosensitive drum 30, the transfer of the toner image onto the intermediate transfer belt 50B and the second transfer onto the recording paper. When the cleaning blade 53 is disconnected from the intermediate transfer belt 50B, the rotational load of the intermediate transfer belt 50B changes, and the conveyance velocity of the intermediate transfer belt 50B may easily vary. In the high quality image mode of the present embodiment however, the cleaning blade 53 and the intermediate transfer belt 50B are kept apart from each other during the image formation, the transfer of the toner image onto the intermediate transfer belt 50B, and the second transfer onto the recording paper. Thus, the stability of the conveyance of the intermediate transfer belt 50B can be increased, and a higher picture quality can be obtained for the formed image.

Thus, the requirements of high image quality and high speed both can be satisfied by adopting the configuration explained above, which can be switched between a high image quality mode and a high speed mode. In the present embodiment a long perimeter is used for the intermediate transfer belt 50B, as has been explained above, because, compared to the intermediate transfer belt 50 of the first embodiment, an additional imageless area corresponding to one revolution of the photosensitive drum 30 is necessary on the intermediate transfer belt 50B. Therefore, instead of prolonging the perimeter of the intermediate transfer belt 50B, it is also possible to stop the rotation of the intermediate transfer belt 50 for a period corresponding to one revolution of the photosensitive drum 30 when the image formation is started. In this case, an even smaller apparatus can be provided with a high image quality mode and a high speed mode. The high image quality mode is not limited to full color image formation, but similarly can be used for multicolor image formation with two or three colors, or for monocolor image formation using only a single color.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color image forming apparatus comprising:

a plurality of image forming units corresponding to various colors, each of said image forming units comprising a developing device;

a unit retaining member for retaining said image forming units and moving said image forming units between an image forming position and a waiting position;

a photosensitive drum having a surface on which various color toner images developed by said developing device are formed;

an intermediate transfer unit comprising an intermediate transfer belt for successive transfer and superposition of toner images of various colors from said photosensitive drum so as to form a color toner image on a surface of said intermediate transfer belt; and a secondary transfer device for transferring the color toner image on said intermediate transfer belt onto a transfer material, wherein said intermediate transfer unit comprises four rollers:

a driving roller for supporting said intermediate transfer belt and driving said intermediate transfer belt;

a following roller for supporting said intermediate transfer belt and following said intermediate transfer belt;

a primary transfer roller for supporting said intermediate transfer belt; and a backup roller for supporting said intermediate transfer belt and arranged in opposition to said secondary transfer device, said primary transfer roller is arranged between said following roller and said driving roller with respect to a rotation direction of said intermediate transfer belt, and said backup roller is arranged between said following roller and said driving roller with respect to the rotation direction of said intermediate transfer belt, on a side that is different from a side of said primary transfer roller, wherein said intermediate transfer belt is only supported by said driving roller, said following roller, said primary transfer roller and said backup roller, and said primary transfer roller and said backup roller are arranged adjacent to said driving roller.

2. The color image forming apparatus according to claim 1, wherein said intermediate transfer unit is removably attached to a machine body of the image forming apparatus, whereby said intermediate transfer belt is brought into contact with or is separated from said photosensitive drum in a direction perpendicular to an axis direction of said photosensitive drum and in a normal direction of a peripheral surface of said photosensitive drum, and at least a portion of said intermediate transfer belt supported by said following roller and said primary transfer roller comes into contact with the peripheral surface of said photosensitive drum.

3. An intermediate transfer unit, comprising an intermediate transfer belt for successive transfer and superposition of toner images of various colors from a photosensitive drum so as to form a color toner image on a surface of said intermediate transfer belt, wherein said intermediate transfer unit comprises four rollers:

a driving roller for supporting said intermediate transfer belt and driving said intermediate transfer belt;

a following roller for supporting said intermediate transfer belt and following said intermediate transfer belt;

a primary transfer roller for supporting said intermediate transfer belt; and a backup roller for supporting said intermediate transfer belt and arranged in opposition to a secondary transfer device for transferring the color toner image on said intermediate transfer belt onto a transfer material, said primary transfer roller is arranged between said following roller and said driving roller with respect to a rotation direction of said intermediate transfer belt, and said backup roller is arranged between said following roller and said driving roller with respect to the rotation direction of said intermediate transfer belt, on a side that is different from a side of said primary transfer roller, wherein said intermediate transfer belt is only supported by said driving roller, said following roller, said primary transfer roller and said backup roller, and said primary transfer roller and said backup roller are arranged adjacent to said driving roller.

* * * * *